US009915130B2

(12) United States Patent
Betsch et al.

(10) Patent No.: US 9,915,130 B2
(45) Date of Patent: Mar. 13, 2018

(54) METHOD FOR ASSESSING THE PERFORMANCE OF A DRILL BIT CONFIGURATION, AND FOR COMPARING THE PERFORMANCE OF DIFFERENT DRILL BIT CONFIGURATIONS FOR DRILLING SIMILAR ROCK FORMATIONS

(71) Applicants: Laetitia Betsch, Tananger (NO); Oskar Johansen, Kokstad (NO); Franck Boutot, Aberdeen (GB)

(72) Inventors: Laetitia Betsch, Tananger (NO); Oskar Johansen, Kokstad (NO); Franck Boutot, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 737 days.

(21) Appl. No.: 14/362,967

(22) PCT Filed: Nov. 15, 2012

(86) PCT No.: PCT/EP2012/072710

§ 371 (c)(1),
(2) Date: Jun. 5, 2014

(87) PCT Pub. No.: WO2013/083380

PCT Pub. Date: Jun. 13, 2013

(65) Prior Publication Data

US 2014/0318866 A1 Oct. 30, 2014

(30) Foreign Application Priority Data

Dec. 5, 2011 (GB) ..... 1120916.0

(51) Int. Cl.
*E21B 41/00* (2006.01)
*E21B 10/00* (2006.01)

(52) U.S. Cl.
CPC ..... *E21B 41/0092* (2013.01); *E21B 10/00* (2013.01)

(58) Field of Classification Search
CPC ..... E21B 41/0092; E21B 10/10; E21B 12/02
See application file for complete search history.

(56) References Cited

U.S. PATENT DOCUMENTS

| | | | | |
|---|---|---|---|---|
| 6,408,953 | B1 * | 6/2002 | Goldman | E21B 12/02 175/39 |
| 2006/0074616 | A1 | 4/2006 | Chen | 703/10 |
| 2006/0162968 | A1 | 7/2006 | Durairajan et al. | 175/431 |

OTHER PUBLICATIONS

International Search Report and Written Opinion, Application No. PCT/EP2012/072710, 10 pages, dated Feb. 3, 2014.

(Continued)

*Primary Examiner* — Manuel L Barbee
(74) *Attorney, Agent, or Firm* — Baker Botts L.L.P.

(57) ABSTRACT

There is disclosed herein a method for assessing the drilling performance of a drill bit configuration used to drill at least a portion of a wellbore in a formation, comprising: determining a value of at least one drill bit performance parameter at points along the wellbore, at least including at multiple points along an interval constituting at least part of the portion drilled using the drill bit configuration; determining rock characteristics for the interval; determining the drilling performance for said drill bit configuration in the interval based on the values for the drill bit performance parameter; and assessing the effectiveness of the drill bit configuration for drilling the interval based on the determined drilling performance and the determined rock characteristics. Also disclosed are related methods for comparing the performance of at least two different drill bit configurations; of designing a drill bit configuration for drilling at (Continued)

least part of a wellbore; for selecting a drill bit design for drilling at least part of a wellbore; and of well planning for drilling wells in a well field.

26 Claims, 18 Drawing Sheets

(56) References Cited

OTHER PUBLICATIONS

Australian Office Action, Application No. 2012348738; 3 pages, dated Jun. 11, 2015.
Canadian Office Action, Application No. 2857707; 4 pages, dated Jul. 28, 2015.
Canadian Office Action, Application No. 2857707; 3 pages, dated May 6, 2016.
International Preliminary Report on Patentability, Application No. PCT/EP2012/072710, 9 pages, dated Jun. 19, 2014.
Office Action received for Canadian Patent Application No. 2857707, dated Feb. 22, 2017; 4 pages.

* cited by examiner

| | | | |
|---|---|---|---|
| Length | 59 | 0 | 150m |
| Dull (In+Out) | 12 | 0 | 16 |
| Gauge Dull | 0 | 0 | 8 |
| Av. ROP | 2.54 | 0 | 5 |
| DD System | | AutoTrak Xtrem | |
| % of Shale | 46% | 0 | 60% |
| Equiv. Pure Sand | 32 | 0 | 150m |
| Rock Hardness | | Soft / Med / Hard | V.Hard |

| | | | |
|---|---|---|---|
| Length | 32.5 | 0 | 150m |
| Dull (In+Out) | 4 | 0 | 16 |
| Gauge Dull | 0 | 0 | 8 |
| Av. ROP | 3.16 | 0 | 5 |
| DD System | | AutoTrak Xtrem | |
| Ile Layers | | 3.3 | |
| % of Shale | 42% | 0 | 60% |
| Equiv. Pure Sand | 19m | 0 | 150m |
| Rock Hardness | | Soft / Med / Hard / V.Hard | |

| | | | |
|---|---|---|---|
| Length | 129 | 0 | 150m |
| Dull (In+Out) | 11 | 0 | 16 |
| Gauge Dull | 0 | 0 | 8 |
| Av. ROP | 2.09 | 0 | 5 |
| DD System | | AutoTrak Xtrem | |
| % of Shale | 30% | 0 | 60% |
| Equiv. Pure Sand | 90.3 | 0 | 150m |
| Rock Hardness | | Soft / Med / Hard / V.Hard | |

METHOD FOR ASSESSING THE PERFORMANCE OF A DRILL BIT CONFIGURATION, AND FOR COMPARING THE PERFORMANCE OF DIFFERENT DRILL BIT CONFIGURATIONS FOR DRILLING SIMILAR ROCK FORMATIONS

RELATED APPLICATIONS

This application is a U.S. National Stage Application of International Application No. PCT/EP2012/072710 filed Nov. 15, 2012, which designates the United States and claims the benefit of Great Britain Application No. 1120916.0 filed Dec. 5, 2011, which are incorporated herein by reference in their entirety.

FIELD OF THE INVENTION

The present invention relates to a method for assessing the drilling performance of a drill bit configuration used to drill at least a portion of a wellbore in a formation, to a related method for comparing the performance of at least two different drill bit configurations, and to a method for selecting a drill bit design for drilling at least part of a wellbore. The invention also relates to a method of designing a drill bit configuration for drilling at least part of a wellbore in a formation, to a drill bit manufactured according to a design arrived at by that method, to methods of well planning for drilling wells in a well field, and to a computerized system for carrying out any of these methods.

BACKGROUND

In the oil well drilling industry, it is important to reduce the economic cost of drilling a wellbore in order to extract oil and gas from underground reservoirs. With underground resources becoming accessible at even greater depths, it becomes evermore important to identify the most efficient and effective drilling configuration to be used in order to drill through the intervening rock formation and access the underground reservoir.

In order to plan any well drilling operation, it is common to conduct a preliminary study of the intervening rock formation between the surface and the underground reservoir, and to select and design a series of drill bits and drill bit configurations to be used in drilling a wellbore through the formation to the reservoir.

In any formation, there will often be a number of different types of rock, as well as one or more intervals, along the determined path of the wellbore, which provide a particular resistance to being drilled. Where such intervals can be identified, the drilling operation can be planned in advance so that drill bits capable of a high rate of penetration can be used in non-problematic sections of the wellbore, whilst specialized drill bit configurations which are more resistant to wear and have a greater cutting capacity can be used to drill through the more problematic intervals.

Nevertheless, the geological properties within any such interval will never be constant, and even in the same rock formation, the same apparent type of problematic rock interval can have markedly different constitution as between one interval and the next, both in terms of the geological composition throughout the interval, such as different proportions of different rock types within the formation, or simply a variation in the drillability of the rock, for example due to variations in the rock strength.

These natural variations in the geological properties of the formation make the prediction of drilling performance and the planning of well drilling operations difficult, and limit the accuracy with which any drilling performance can be predicted.

In order to calibrate the predictive models used to plan well drilling operations, accuracy can be improved by utilizing the results of actual drilling measurements obtained in order to compare the expected performance of a drill bit configuration against the actual performance of the drill bit configuration in use. The actual drilling results can be used to refine and improve the predictive drilling model.

Nevertheless, a drilling operator may feel more comfortable proceeding with the design and selection of drill bit configurations based on actual drilling results which have been obtained by using one or more particular drilling configurations in the field. In such situations, the drilling operator will often seek to compare the like-for-like real life performance of several different drill bit configurations, and will wish to base his selection and design of future drill bit configurations on those drill bit configurations which have proven most successful in actual drilling operations in the field.

In this situation, however, there is an inherent risk that the respective in-field performance results may be misleading as to which drill bit configuration actually provides the best performance. This problem arises due to the inherent natural variations in the geological properties of the formation, meaning that the drilling results from any two real-life drilling intervals can be difficult to compare in a simple side-by-side comparison.

Put in simple terms, if two different drill bit configurations are each used to drill a 100 m interval in a rock formation, for example in parallel wellbores, one cannot simply afterwards assess the measured rate of penetration or the actual time taken to drill through the 100 m interval in order to determine which drill bit configuration performed the best, or directly compare the extent of wear on the two bits to see which was most resistant to bit wear, as one of the two drilled intervals may have had a significantly higher proportion of a rock type which is resistant to being drilled or which produces a significantly higher degree of bit wear. Even where the constitution of the rock types in each interval is similar, one of the intervals may exhibit a significantly larger proportion of rock with high rock strength than the other interval.

It would therefore be advantageous to provide a method for assessing the performance of a drill bit for drilling an interval which takes account of the actual drilling conditions encountered, and which permits a meaningful comparison between the performances of different drill bit configurations used for drilling different intervals of the same or different wellbores.

SUMMARY OF THE INVENTION

According to a first aspect of the present invention, there is provided a method for assessing the drilling performance of a drill bit configuration used to drill at least a portion of a wellbore in a formation, comprising: determining a value of at least one drill bit performance parameter at points along the wellbore, at least including at multiple points along an interval constituting at least part of the portion drilled using the drill bit configuration; determining rock characteristics for the interval; determining the drilling performance for said drill bit configuration in the interval based on the values for the drill bit performance parameter; and assessing the effectiveness of the drill bit configuration for drilling the interval based on the determined drilling performance and the determined rock characteristics.

In one embodiment, the method further includes determining a value of at least one drillability parameter for the formation at each of said multiple points along the interval, and wherein determining the rock characteristics for the interval or determining the drilling performance for said drill bit configuration in the interval is based on the determined values of the at least one drillability parameter at said multiple points. Such a method may further comprise dividing said multiple points into groups based on the determined values of the at least one drillability parameter at each of said multiple points. This method may further comprise determining a percentage of the interval constituted by the points in at least one of said groups.

In another embodiment, the method further includes determining a length value at each of said points, corresponding to a length drilled by the drill bit configuration. In this case, and where the method includes determining a percentage of the interval constituted by the points in at least one of said groups, the percentage may correspond to the sum of the length values of the points within the at least one group out of the total length of the interval. Moreover, here, the length value at each point may be determined by calculating at least one from the group consisting of: the distance between that point and the adjacent next point; half of the distance between the adjacent previous point and the adjacent next point; and the length of the whole interval divided by the total number of the multiple points.

Where the method comprises determining a percentage of the interval constituted by the points in at least one of said groups, the percentage may correspond to the total number of points within the at least one group out of the total number of the multiple points along the interval.

In still another embodiment, the method further includes determining a value of at least one lithology parameter for the formation at each of said multiple points along the interval, and wherein determining the rock characteristics for the interval is based on the determined values of the at least one lithology parameter at said multiple points.

In yet another embodiment, determining the rock characteristics for the interval may include determining the percentage of two or more different rock types within the formation in said interval.

In a further embodiment, determining the rock characteristics for the interval may include determining the rock type, of two or more rock types within the formation, at each of said multiple points along the interval.

In a yet further embodiment, determining the drilling performance for said drill bit configuration includes determining an average value for the drill bit performance parameter. In this case, determining an average value for the drill bit performance parameter may include one selected from the group consisting of: dividing the sum of the values for the drill bit performance parameter for the multiple points along the interval by the total number of the multiple points; multiplying the value of the drill bit performance parameter for each point along the interval by the length value for that point to obtain a length-weighted performance value for each point, and dividing the sum of the length-weighted performance values for the multiple points by the total length of the interval. Equally, determining an average value for the drill bit performance parameter may include determining a group average performance parameter value, comprising one selected from the group consisting of: dividing the sum of the values for the drill bit performance parameter for the points within one or more of the groups by the total number of points within that or those groups; and multiplying the value of the drill bit performance parameter for each point within one or more of the groups by the length value for that point to obtain a length-weighted performance value for each point within the one or more groups, calculating a total length value for the one or more groups as the sum of the length values for the points within said one or more groups, and dividing the sum of the length-weighted performance values by the total length value for the one or more groups. In the latter case, determining a group average performance parameter value may include: determining the average performance parameter value for a first set of one or more of the groups; and determining the average performance parameter value for a second set of one or more of the groups, different from the groups in the first set. Determining a group average performance parameter value may includes one selected from the group consisting of: determining the average performance parameter value for a number of sets, each set including one or more groups different from the groups in any of the other sets, wherein every group is included in one of the sets; and determining the average performance parameter value for each group.

In such embodiments, determining the drilling performance for said drill bit configuration in the interval may include multiplying the determined average performance parameter for each set or group by a drillability weighting factor and summing all of the drillability-weighted average performance parameters for each determined set or group. Here, the drillability weighting factor for one or more, but not all, of the sets or groups may be zero.

In embodiments where determining the rock characteristics for the interval includes determining the rock type, of two or more rock types within the formation, at each of said multiple points along the interval and determining the drilling performance for said drill bit configuration includes determining an average value for the drill bit performance parameter, determining an average value for the drill bit performance parameter may include determining a rock type average performance parameter value, comprising one selected from the group consisting of: dividing the sum of the values for the drill bit performance parameter for the points corresponding to at least one of the two or more rock types within the formation by the total number of points corresponding to the at least one rock type; and multiplying the value of the drill bit performance parameter for each point corresponding to at least one of the two or more rock types by the length value for that point to obtain a length-weighted performance value for each point corresponding to the at least one rock type, calculating a total length value for the at least one rock type as the sum of the length values for the points corresponding to the at least one rock type, and dividing the sum of the length-weighted performance values by the total length value for the at least one rock type. In this embodiment, determining a rock type average performance parameter may include one selected from the group consisting of: determining the average performance parameter value for a number of sets, each set including one or more of the rock types different from the rock types in any of the other sets; and determining the average performance parameter value for two or more, or each, of the rock types. Also, in this embodiment, determining the drilling performance for said drill bit configuration in the interval may include multiplying the determined average performance parameter for each rock type by a drillability weighting factor and summing all of the drillability-weighted average performance parameters for each determined rock type. In that case, the drillability weighting factor for one or more, but not all, of the rock types or sets may be zero.

In still yet another embodiment, assessing the effectiveness of the drill bit configuration for drilling the interval based on the determined drilling performance and the determined rock characteristics comprises: identifying one or more factors relevant to drillability in the interval; and determining whether the drilling performance for said drill bit configuration has been affected by said factors. Here, identifying one or more factors includes identifying groups of values of one or more of a drillability parameter and a drill bit performance parameter at said multiple points along the interval, into which groups said multiple points along the interval may be divided. Furthermore, identifying one or more groups of the values of the drillability parameter or drill bit performance parameter may include outputting a visual or numerical representation of the distribution of the drillability parameter values within the interval, and preferably includes plotting a histogram of the values for said parameter at the multiple points along the interval.

In even yet another embodiment, assessing the effectiveness of the drill bit configuration for drilling the interval based on the determined drilling performance and the determined rock characteristics comprises eliminating a selection of points, out of said multiple points along the interval, from the determination of the drilling performance for said drill bit configuration in the interval.

In still even another embodiment, assessing the effectiveness of the drill bit configuration for drilling the interval based on the determined drilling performance and the determined rock characteristics comprises applying a weighting factor to one or more drilling performance values constituting the determined drilling performance for said drill bit configuration in the interval.

In yet still even another embodiment, assessing the effectiveness of the drill bit configuration for drilling the interval based on the determined drilling performance and the determined rock characteristics comprises plotting at least one drillability parameter as an accumulative drillability parameter against length drilled.

In the foregoing embodiments, the at least one drillability parameter may include one or more selected from the group consisting of: unconfined rock strength; confined rock strength; weight on bit; bit rotation speed; drilling fluid flow rate; hole inclination; and dogleg severity.

Furthermore, the at least one drill bit performance parameter may include one or more selected from the group consisting of: length drilled; rate of penetration; bit wear volume; bit dull grade; number of stringers drilled; accumulated strength of stringers drilled; time taken to drill stringers or hard rock types; surface drilling torque; bit drilling torque; surface sliding torque; bit sliding torque; weight on bit; mechanical specific energy; dogleg severity; accumulated bit revolutions; mean time between failures; stick slips; and vibrations, providing the same parameter has not been used as a drillability parameter.

In a still even further embodiment, determining a value of at least one drill bit performance parameter at points along the wellbore and determining rock characteristics for the interval includes obtaining a drilling log for at least the portion of the wellbore drilled using said drilling configuration.

According to a second aspect of the present invention, there is provided a method for comparing the performance of at least two different drill bit configurations, comprising: assessing the drilling performance of each drill bit configuration during the drilling of respective intervals in respective portions of the same or different wellbores according to the method of the first aspect; and comparing the respective assessed drilling performances.

In an embodiment of the first aspect, comparing the respective assessed performances comprises determining an effective drilling performance for each drill bit configuration by normalizing the drilling performances of all compared drill bit configurations based on the respective rock characteristics determined for the interval drilled by each drill bit configuration. Here, the normalized drilling performance for each configuration includes one or more selected from the group consisting of: the effective length drilled in a particular type of rock; the effective average rate of penetration in a particular type of rock; the effective rate of wear in a particular type of rock; the effective length drilled in formation rocks having a particular range of values of at least one drillability parameter; the effective average rate of penetration in formation rocks having a particular range of values of at least one drillability parameter; and the effective rate of wear in formation rocks having a particular range of values of at least one drillability parameter.

In certain embodiments, determining an effective drilling performance for each drill bit configuration includes adjusting the respective assessed drilling performances by eliminating from the assessment of the respective drilling performances performance data in non-comparable sections of the respective drilled intervals.

In a further embodiment, comparing the respective assessed performances comprises plotting at least one drillability parameter as an accumulative drillability parameter against length drilled for individual drill bits used in the or each drill bit configuration, from the commencement until the termination of drilling with each individual drill bit.

According to a third aspect of the present invention, there is provided a method for selecting a drill bit design for drilling at least part of a wellbore, comprising: comparing the performance of at least two different drill bit configurations by the method of the second aspect; and selecting the drill bit configuration exhibiting the highest assessed drilling performance.

In an embodiment of the third aspect, comparing the respective assessed performances comprises determining an effective drilling performance for each drill bit configuration by normalizing the drilling performances of all compared drill bit configurations based on predicted rock characteristics for the part of the wellbore to be drilled.

According to a fourth aspect of the present invention, there is provided a method of designing a drill bit configuration for drilling at least part of a wellbore in a formation comprising: assessing the drilling performance of a drill bit configuration used to drill at least a portion of a wellbore in a formation by the method according to the first aspect; and adapting the drill bit configuration based on the assessed effectiveness of the drill bit configuration in the drilled interval and based on predicted rock characteristics for the part of the wellbore to be drilled.

In an embodiment of the fourth aspect, designing the drill bit configuration includes designing the drill bit and recording the drill bit design.

According to a fifth aspect of the present invention, there is provided a method of well planning for drilling wells in a well field, comprising: drilling at least one well bore in the well field; assessing the drilling performance of at least one drill bit configuration used to drill at least a portion of the wellbore in a formation of the well field according to the method of the first aspect; and planning the drill bit configuration to be used in a similar portion of at least one successive wellbore in the same formation based at least in part on said assessment.

In an embodiment of the fifth aspect, the method includes designing a drill bit configuration by the method according to the fourth aspect, for drilling at least part of a successive wellbore in the well field.

According to a sixth aspect of the present invention, there is provided a method of well planning for drilling wells in a well field, comprising: drilling at least two portions of the same wellbore or different wellbores in the well field using two or more different drill bit configurations; and planning the drill bit configuration to be used in a similar portion of at least one successive wellbore in the same formation by selecting a drill bit configuration from said two or more different drill bit configurations by the method according to the third aspect.

In the foregoing aspects and embodiments, all or part of said method may be implemented using a computer.

According to a seventh aspect of the present invention, there is provided a computerized system for assessing the drilling performance of a drill bit configuration used to drill at least a portion of a wellbore in a formation, the system being arranged to implement the method of any preceding claim.

The methods of the foregoing aspects and embodiments may further comprise drilling the wellbore, including drilling the interval using the drill bit configuration to be assessed.

In the foregoing aspects and embodiments, the system or method may output the result of the method to a computer-controlled resource.

According to an eighth aspect of the present invention, there is provided a drill bit manufactured according to the design of the fourth aspect.

An advantage obtainable with embodiments of the invention is to determine one or more measurements of the performance of a drill bit for drilling a particular interval in a rock formation which takes account of the different types of rock in the formation within the drilled interval. The method may also, or equivalently, take account of variations in the drillability characteristics of the rock type or types within the interval. In this way, an effective performance value can be derived for the assessed drill bit configuration, which can be compared with the performance of other drill bit configurations used for drilling similar intervals.

In one example, the proportion of each of two or more different types of rock within the interval is identified, and the effective performance of the drill bit is assessed as being that which corresponds only to the drilling of the difficult-to-drill types of rock, whilst the effect of drilling non-problematic types of rock can be ignored. In this way, non-representative measurements which arise within the interval to be investigated can be eliminated.

Where two or more different rock types exist, and where the effect of one rock type on drilling performance is less significant than one or more of the other rock types, but not negligible, then a performance value for each rock type can be determined, and if desired appropriate weighting values can be applied to the performance value for each rock type, in order to arrive at a total effective performance value for the drill bit configuration for the interval as a whole.

The assessment of the drill bit configuration within the drilled interval can also take account of a drillability parameter, which may vary within rock of the same type within the interval. In the case of the confined or unconfined rock strength, for example, a distribution of the rock strength, showing the proportion of the drilled interval having a value of rock strength within two or more groups or sets of rock strength values, can be produced.

This information can be used, in one way, by applying appropriate weighting factors to the performance characteristics corresponding to each of the identified groups based on rock strength or another drillability parameter. This will, again, give an effective or normalized performance value for the drill bit configuration within the interval. As an alternative, the distribution of the drillability parameter can be plotted, or otherwise expressed numerically or mathematically, in order to permit a comparison between the drillability parameter distribution for different drilled intervals.

Returning to the example of rock strength, this can allow the rock strength distribution for one drilled interval to be compared qualitatively and/or quantitatively with the rock strength distribution for another drilled interval, which can permit a determination of reasons for any variations in the performance of the drill bit configurations used to drill each interval. For ease of graphical reference, the drillability distribution can be plotted as a histogram, based on the actual measurement results outputted as a drilling log of the wellbore drilling operation, for the portion of the wellbore corresponding to the interval to be investigated.

BRIEF DESCRIPTION OF THE DRAWINGS

To enable a better understanding of the present invention, and to show how the same may be carried into effect, reference will now be made, by way of example only, to the accompanying drawings, in which: —

DETAILED DESCRIPTION

Embodiments of the method of the present invention seek to provide a method for assessing the performance of a drill bit configuration within a particular drilling interval by isolating those measurements which are pertinent to the assessment of the performance of the drill bit configuration, and/or by eliminating or otherwise accommodating data corresponding to portions of the drilled interval which are less significant for assessing the performance of the drill bit.

Herein, the term "drill bit configuration" is intended to encompass not only the specific design of a particular drill bit, for example, in terms of the number of blades and the position and placement of cutters, in the case of a fixed blade PDC cutter drill bit, or the specific design of teeth and cones in a roller cone drill bit, but also the configuration of the associated downhole assembly (also known as a bottom hole assembly) to which the drill bit in question is attached. For example, the drill bit configuration might include a downhole motor.

One particular example where such a method may be employed is in assessing the durability of PDC (polycrystalline diamond compact) cutters. Some rock types are known not to have an impact on PDC cutter wear, whilst other rock types will have a significant impact on PDC cutter wear. In the evaluation of the performance of a PDC cutter in a drilled interval including both rock types which impact on PDC cutter wear and rock types which are known not to have a significant impact on PDC cutter wear, the performance of the PDC cutter within the interval can be more meaningfully evaluated by isolating the rock types of the formation which are known to have an impact on PDC cutter wear and eliminating or otherwise applying a minimizing weighting factor to the other rock types. The resulting output is a measure of the effective performance of the PDC cutter drill bit, for drilling through the relevant types of difficult-to-drill rock.

Figure 1:
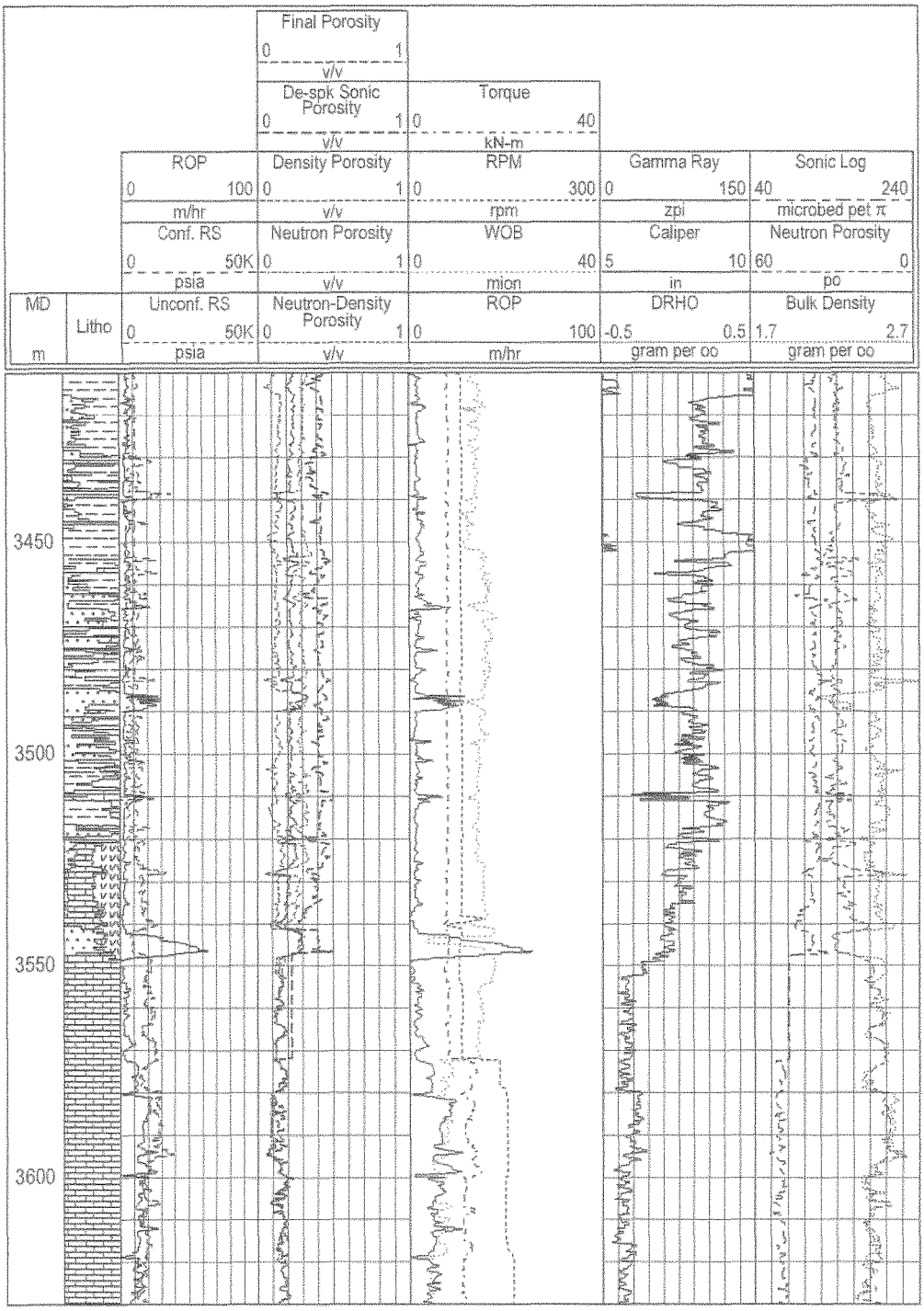
FIG. 1 shows an example of a well drilling log exhibiting various logging data.

Turning to FIG. 1, there is shown an example of a typical well drilling log obtained by taking various measurements before, during and/or after drilling a wellbore. The drilling log plots various measurements and/or calculated parameter values against the distance along the wellbore (also referred to herein as the "depth").

In this context, it should be noted that, in the drilling of a wellbore, different drill bit configurations may be utilized for drilling different sections of the wellbore, and that different sections of the wellbore may have different diameters. When assessing the performance of any particular drill bit configuration, only parameter values corresponding to sections of the interval drilled by the same drill bit configuration should be taken into account, if any meaningful measure of the performance of the drill bit configuration is to be obtained. Similarly, when comparing the performance of two or more different drill bit configurations for drilling similar formation intervals, a meaningful comparison between the performance of the drill bits can only be made where the different drill bit configurations have drill bits for drilling wellbores of the same diameter. In such cases, there should also be a significant degree of similarity between the formations in each respective drilled interval, at least in terms of the general composition of rock types present. On the other hand, for certain drilling operations, it may be useful to evaluate the relative performance of different drill bit configurations for drilling bores of different diameters, especially when deciding on what drill bit configuration will be most suitable or efficient for drilling a planned well bore, or a section thereof. For example, if the drilling operator has to select between drilling a section of the formation using a 6" drill bit or an8½" drill bit, it may not be clear which configuration will be most effective. In principle, a 6" drill bit can drill more easily through the formation as it has to remove less formation material for each incremental depth drilled. However, smaller diameter drill pipe cannot be subjected to the same loading (WOB) as larger diameter drill pipes without buckling, and cannot transmit such high torque. Suitable comparative analyses can help the operator assess in advance which drill bit configuration will be most effective in practice.

Various types of data are included in the well drilling log of FIG. 1, including a lithology trace, the confined and unconfined rock strength (CRS and URS), weight on bit (WOB) and rate of penetration (ROP).

As can be identified from FIG. 1, however, it is difficult to make any quantitative assessment of the different sections of the wellbore shown in FIG. 1, beyond mere generalizations that could apply to any number of similar intervals in different wellbores. Embodiments of the present invention therefore seek to at least partially quantify the data from such a well log in order to permit a meaningful assessment of the performance of a drill bit configuration, and a meaningful comparison between the performance of different drill bit configurations in similar wellbore intervals.

A first step in the assessment of the performance of the drill bit configuration involves identifying the relevant interval for assessment. In general, the relevant interval can be identified from the well drilling log by reference to the identified lithology along the wellbore, or by reference to the plot of confined rock strength or unconfined rock strength, from which any intervals which are problematic for drilling can be identified. The relevant interval might also have been identified during the well planning stage, and an appropriately durable and effective drill bit configuration will have been provided to drill the interval in question.

Figure 2:
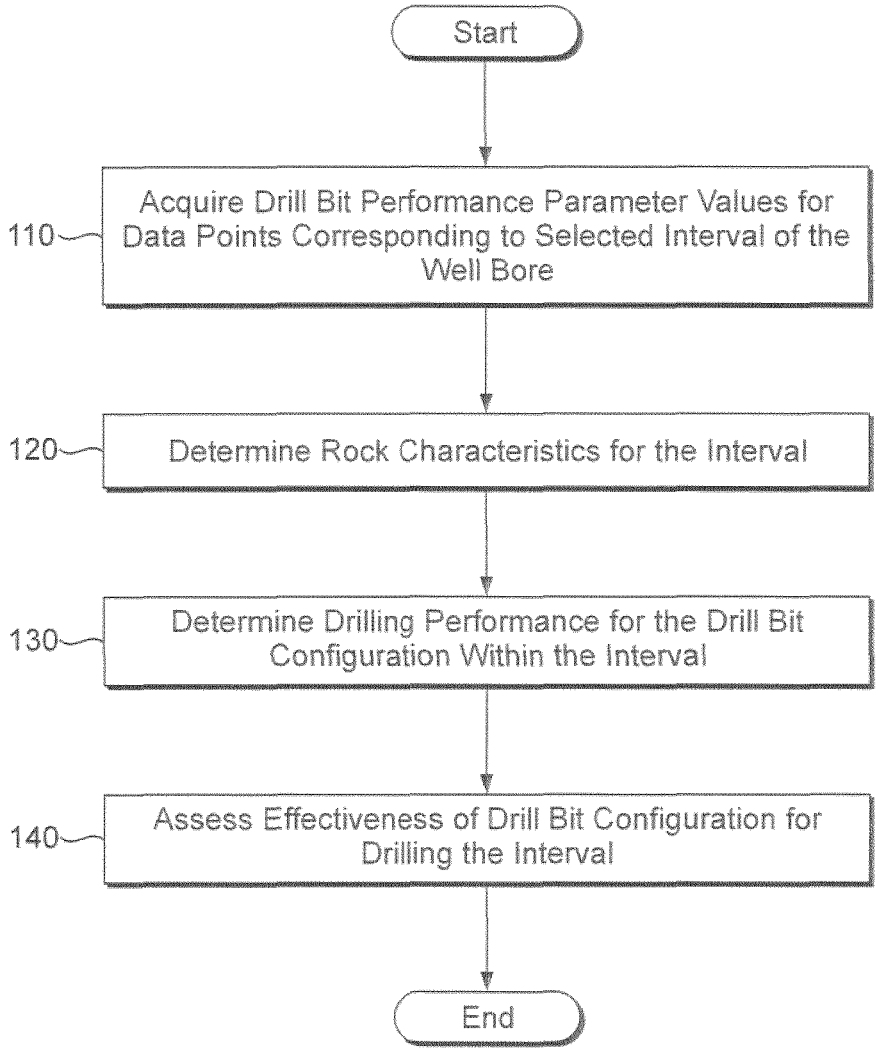
FIG. 2 shows a flow diagram for a method according to the present invention.

Turning to FIG. 2, there is shown a flow diagram which outlines one method according to the invention for assessing the performance of a drill bit configuration.

Step 110 involves acquiring drill bit performance parameter values for data points corresponding to the selected interval of the wellbore to be investigated. The drill bit performance parameter values allow the determination or calculation of one or more relevant performance criteria for the drill bit configuration within the interval. Typical such performance characteristics include the degree of wear experienced by the bit during drilling the interval, typically expressed as "inner" and "outer" wear volumes or dull grades, a measurement of the actual length drilled, the rate of penetration made by the drill bit whilst drilling the interval and the overall bit dull grade.

In some cases, these values cannot be obtained directly from a well log, but can be acquired from further reports, such as a directional drilling report or the report produced by a drilling operator. For example, the degree of bit wear and dull grade will typically be assessed following completion of the drilling of the interval in question, after the drill bit has been removed and sent for analysis. In the alternative, there are also available predictive measures of drill bit wear, based, for example, on vibrational analysis, which may form part of a well drilling log to give an instantaneous approximation of the degree of wear of the drill bit.

Step 120 determines the rock characteristics for the interval. This may again involve acquiring data from the well drilling log, which may again involve taking values measured directly during the drilling of the wellbore, or values calculated on the basis of such measurements. Equally, measurements taken before and/or after drilling of the wellbore may be used, including seismic survey data and measurements taken during a subsequent run with a downhole analysis tool. Mud logging data can also be used to acquire an accurate representation of the rock characteristics for the interval.

In step 130, the drilling performance for the drill bit configuration is determined for the interval being investigated. There are various parameters which can be used to define the drill bit performance. The particular parameter of interest will vary according to the particular performance criteria which one wishes to assess.

In the above example of the drilling of a problematic interval using a polycrystalline diamond compact (PDC) cutter drill bit, the important criteria will likely include the rate of penetration which the drill bit is able to achieve through the problematic interval, this determining the overall time taken to drill through the interval and, consequently, the associated cost of drilling that interval. At the same time, the performance of the drill bit configuration can be characterized by its durability, in terms of the degree to which the drill bit has become worn through drilling the problematic rock interval. This will give a representation of the total distance through such a rock formation which a drill bit would be capable of drilling. Such an indication is important for the planning of future well drilling operations, since a fully-worn drill bit has to be pulled back out of the well and replaced. In certain situations, therefore, it will actually be more economical to utilize a single drill bit which can drill through the entire interval, albeit at a reduced rate of penetration, rather than using a drill bit configuration which is capable of a higher rate of penetration but which will wear out before the interval has been completely drilled through and so will require replacement. Of course, in order to replace a drill bit, the drill string must be "tripped" out of the wellbore. Then, a new drill bit must be attached to the drill string and "tripped" back into the wellbore. Depending on the depth of the wellbore, this process can take an extended period of time.

A parallel measurement of a drill bit configuration's performance is to assess the effective or normalised length which has been drilled by the drill bit. This may be done by determining the proportion of the interval which is made up of problematic rock types, and then assessing the effective length which the drill bit configuration has drilled through the problematic rock types.

In order to provide a meaningful measure of the drilling performance of the drill bit configuration, it is necessary to identify and select which of the data values within the interval are relevant to the actual assessment of the drill bit configuration performance. Determination of the effective length of problematic rock drilled by the drill bit within the interval is one such relevant measurement. This performance measure can be obtained in a number of different ways.

A first possibility is to identify the proportion of different rock types within the drilled interval, which may be done using the lithology assessment which typically forms part of the well drilling log. Having identified the different rock types within the problematic interval, it is then possible to assess which rock type or types are problematic to the performance of the drill bit configuration, and so are relevant in determining the effectiveness of the drill bit configuration for drilling the specified interval. By way of example, in a shale and sandstone formation, drilled using a PDC cutter drill bit, shale can be characterized as being non-problematic, as it is typically soft and non-abrasive, whilst sandstone is isolated as a problematic rock type, since it is a source of abrasive wear on PDC cutters. Therefore, in order to determine the effective degree of wear arising from drilling such an interval, it is only necessary to consider the parts of the interval where the drill bit was drilling through the problematic rock, in this case sandstone.

The percentage of each rock type in the interval is determined as a volume percentage in a typical lithology trace. As the diameter of the wellbore interval should be constant, then the length of each rock type which the drill bit configuration has drilled through corresponds directly to the volume percentage of each rock type. As such, the effective length drilled can be determined as being the total interval length multiplied by the percentage of the problematic rock type or types within the interval.

For example, in the above-mentioned shale and sandstone formation, if the percentage of shale is 40% and the percentage of sandstone is 60%, whilst the length of the selected interval for investigation is 100 m, then the effective length drilled by the PDC cutter drill bit would correspond to the equivalent length drilled through pure sandstone, being 60%×100 m, which is 60 m. This relatively simple calculation permits a better understanding of the drill bit configuration performance, and eliminates any meaningless information (as far as the wear rate of the drill bit is concerned) acquired during drilling of the interval as a whole.

Step 140 in the method of FIG. 2 then proceeds to assess the effectiveness of the drill bit configuration for drilling the interval. In this assessment, the relevant performance characteristic can be compared with knowledge of the rock characteristics for the interval, as well as any further relevant information from any other reports, including the well drilling log. For example, the drilling operator's report will indicate if, and at what depth position, the drill bit became fully worn and had to be replaced, or any other significant events or characteristics involved in the drilling interval.

For example, in assessing the effectiveness of the drill bit configuration used for drilling the interval, a comparison might be made between the effective length drilled through a problematic rock type and the degree of wear of the drill bit at the end of drilling the interval. As drill bit wear is not a uniform process the measurement of dull grade, as well as characterization of the type and position of wear, can be used to better inform the assessment of the effectiveness of the drill bit configuration for drilling the interval.

It is also clear that, even within the sandstone portions of the interval drilled, there may be significant variations in the actual rock strength of the drilled rock. The performance value measurements for the drill bit configuration within the interval can therefore be assessed against the measured or calculated rock strength encountered whilst drilling the formation. Even though such rock strength calculations or measurements may be included in a well drilling log, however, the well drilling log does not readily permit a direct quantitative assessment of the overall drillability of the rock, and typically only permits a qualitative assessment of the relative drillability at different depth positions.

In order to better assess the performance of the drill bit configuration during the interval, it is helpful to gain some measure of the distribution of the rock drillability within the interval. In the example of the confined or unconfined rock strength, a rock strength distribution for the interval may be obtained by separating the measured or calculated values for the rock strength at each data point in the well drilling log within the interval into a number of groups corresponding to different values for the rock strength. The relative proportions of rock in the interval which has a rock strength falling within each rock strength group can then be assessed, in order to determine qualitatively and quantitatively the distribution of rock strength within the interval.

A visual assessment may be facilitated by plotting a histogram of the data points for the rock strength measurements or calculations, in order to show the concentrations of data points at any particular rock strength value. The size and number of groups to be used can be determined with reference to the highest and lowest values for the rock strength measured or calculated for the data points within the interval. The groups may then be defined by selecting upper and lower limits which encompass all of the measurements or calculated values for drillability which have been obtained, and dividing the range of values between said upper and lower limits into a number of equally sized groups. The distribution of the drillability values can then be ascertained, in one way, by identifying the number of individual data points which fall within each group. In the example of rock strength, the measurement of rock strength in kPsi might be divided into groups each covering a range of 1,000 Psi (for example 0 to 1,000 Psi, greater than 1,000 to 2,000 Psi, greater than 2,000 to 3,000 Psi, etc).

When plotted, the rock strength distribution can reveal the overall nature of the drillability throughout the interval as a whole. Examples of such plots of data points are shown in FIGS. 5A to D and 6 A to D, which respectively show confined and unconfined rock strength distributions for different drilled intervals.

In order to facilitate the visual assessment of the rock strength distribution, the groups of data points have been divided into a number of sets, each encompassing a number of the groups of rock strength values. The limits for the sets, in this example, are able to be chosen by the rock strength analyst, and may be chosen so as to permit a relative comparison between a number of different rock strength distributions to be made. That is to say that the same groups and sets of values should be utilized for all rock strength, or other drillability parameter, distributions to be assessed, in order to aid their relative comparison.

In the example of FIGS. 5A to D, the sets have been set to correspond to values below 15 kPsi, from 15 to 20 kPsi, from 20 to 30 kPsi, and to values above 30 kPsi. In the example of FIGS. 6A to D, the sets are chosen so as to define values below 15 kPsi, from 15 to 20 kPsi, from 20 to 30 kPsi, and for all values above 30 kPsi. (In FIGS. 6A to D, all values are, in any case, below the upper boundary of 30 kPsi, and in the example of distributions 510 and 520, the values are all, respectively, below 28 kPsi and 27 kPsi.

Another informative parameter relating to the performance of the drill bit configuration will be the rate of penetration obtained within the interval. A measurement of the average rate of penetration throughout the whole interval can aid in assessing the overall performance of the drill bit configuration. Equally, it may be desirable to calculate an average rate of penetration (ROP) only within the portions of the interval which correspond to the problematic rock type. In the case of rate of penetration measurements, however, the average rate of penetration cannot simply be read out from the ROP measurements appearing in the data log, and has to be back-calculated from all selected points within the interval. This is because the data points measured in the well drilling rock are distance separated, and not time separated as would be relevant for an overall calculation of the rate of penetration.

In the simple example of determining an overall rate of penetration for the whole interval, then calculating the average ROP within the interval may be done by taking the ROP measurement for each point in turn, and working out the time taken to drill from that point to the next point at the measured ROP. In this way, a time value is obtained for each portion of the well bore between adjacent data points within the drilled interval. To obtain the average ROP, the total interval length is then divided by the sum of the individual time increments for the interval as a whole.

If calculating the average ROP only for selected data points within the interval, then it becomes necessary also to calculate a length interval for each data point, and thereafter to divide the sum of the length increments (rather than the total interval length) by the sum of the time increments, to obtain an average ROP for those selected data points. For example, it might be desirable to calculate the average ROP for the drill bit configuration only within one or more different rock types, or only for sections of rock having a particular drillability characteristic, such as a measured or calculated rock strength falling within a defined range of values.

Figure 3:
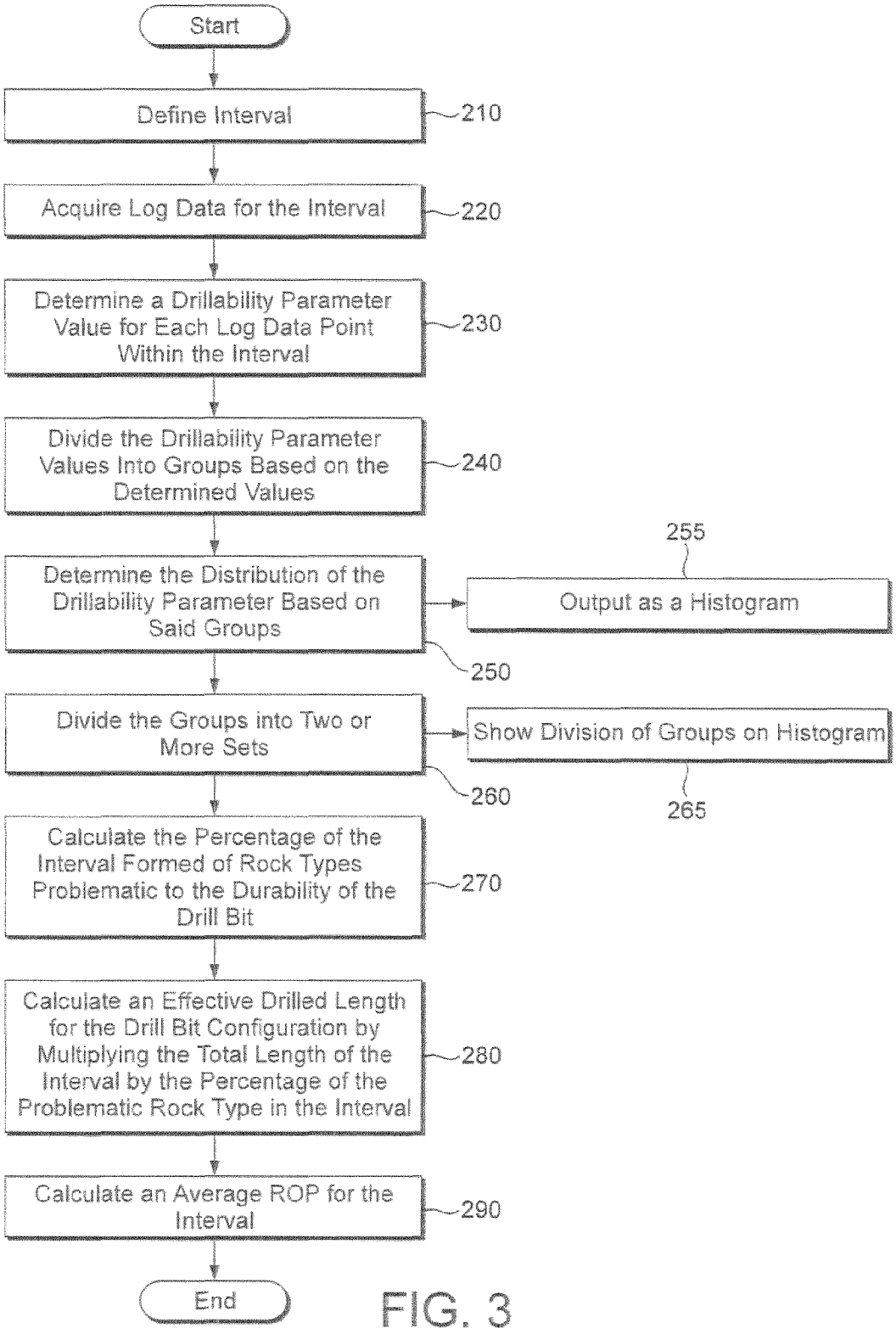
FIG. 3 shows a flow diagram for a further embodiment of a method according to the present invention.

Turning to FIG. 3, a particular method for assessing the performance of a drill bit configuration is shown in more detail. The following discussion of the method of FIG. 3 is equally applicable to the method shown in FIG. 2.

In step 210, the interval to be investigated is defined. The relevant interval may be selected by reference to a well drilling log, which will reveal an interval of interest based on the rock types present or the drillability characteristics of the drilled wellbore in certain intervals, for example the confined or unconfined rock strength. The interval of interest may otherwise by selected, for example, based on geological survey data or based on the drilling operator's well drilling report, which will indicate, for example, the depths between which a particular drill bit configuration was used to drill through a section of the formation.

In step 220, log data for the interval of interest is acquired. Pertinent data points from the well drilling log may be selected for the further determination of relevant drillability and drill bit performance values or the determination of different rock types or other rock characteristics.

In step 230, the method includes determining a drillability parameter value for each log data point within the interval. As discussed above, the drillability parameter value may be the confined or unconfined rock strength, and may be taken directly from the well drilling log if provided. In other circumstances, however, the relevant drillability parameter will not be included in the data log and must be separately calculated for each data point. (In this context, a data point refers to a single depth position along the wellbore at which a measurement is taken or a value or characteristic is determined, and the data point may include all values or measurements corresponding to that single depth position along the wellbore.)

For example, the rock strength may be calculated from depth based gamma ray, density and neutron porosity measurements taken from within the wellbore either during or after the well drilling operation. As an alternative, the rock strength calculation may be based on the sonic DTC (delta-T compressional) curve, rather than based on density and neutron porosity. Other rock strength calculations are well known, and any such calculation method may be used for assessing the rock strength at each data point along the wellbore, at least within the interval to be investigated.

In step 240, the measured or calculated values for the drillability parameter are divided into groups of ranges encompassing the determined values, as explained above.

Following from step 240, in step 250 the distribution of the drillability parameter is determined based on the selected groups. As mentioned above, this may be achieved in a simple way simply by identifying the number of data points within each selected group, with the distribution corresponding simply to the number of data points within each group. However, the data points within the interval are not necessarily equally spaced throughout the length of the interval, so that a simple distribution based on the number of data points does not necessarily give an accurate reflection of the actual distribution of the drillability parameter within the interval as a whole. It may therefore preferable to determine a length-weighted distribution for the drillability values, along the following lines.

Instead of simply counting the number of data points within each group, a length value is determined for each data point. The length value may be taken as the length from each data point to the next successive data point within the interval, or may be calculated in a number of other ways, such as being half of the length between the preceding adjacent point and the adjacent next point along the wellbore. To obtain the length-weighted distribution, the sum of the length values for each data point in each group is calculated, to give a total length drilled for each drillability parameter group. This may equally be expressed as a percentage of the total length of the interval by dividing the sum of the length values for the points in each group by the total length of the interval. (Note that the same length values should be used wherever an equivalent measurement is required, so, for example, the same length value calculation should be used for determining the length-weighted distribution as would be used for determining the length and time increments in the above-described average ROP calculations.)

At step 255, the determined distribution of the drillability parameter is then outputted as a histogram. Alternatively, the drillability parameter distribution could be outputted in another format, such as a different type of plot or in a numerical form. As explained above, the histogram gives a visual representation of the distribution of the drillability parameter within the interval. Knowledge of the distribution of the drillability parameter can be utilized to explain variations between the performance of a drill bit configuration in different drilling intervals, to facilitate the comparison of performance between different drill bit configurations in similar intervals, or simply to inform the assessment of a drill bit configuration within a single interval.

In step 260, the groups are divided into two or more sets, again as explained above, as a way of characterizing the sets of groups. For example, with reference again to FIGS. 5A to D and 6A to D, the limits for the sets can be determined according to the preference of an analyst, to permit comparison between the drillability parameter distributions of different drilled intervals. Alternatively, the drillability sets may be determined based on a technical assessment of the values above and below which a notable variation in drilling performance can be expected. For example, in the case of rock strength, it may be determined that a drill bit will suffer a significant increase in the degree of wear experienced for values of confined rock strength above, say, 30 kPsi, or that a desired rate of penetration for the drill bit cannot be maintained within rocks having such high rock strength characteristics. Equally, it may be determined that no appreciable degree of wear is incurred in sections of the formation having a confined rock strength below 20 kPsi, or that a higher rate of penetration can be made in such less-hard rock.

As shown in step 265, the divisions for the sets of groups may be indicated on the histogram output at step 255. Again, this aids in the visual assessment to be made by an analyst. Again, the proportions in each set may alternatively be outputted in a numerical format, and/or related data may be added to the histogram in numerical form.

At step 270, the percentage of the interval formed of rock types problematic to the durability of the drill bit is then calculated. As explained above, the percentage of the interval formed of each type of rock present in the drilled formation interval may be calculated from the lithology trace for the wellbore. Where information regarding the proportion of each rock type is not directly available, it is possible to identify the rock type present at each data point along the interval, and then to calculate the proportion of the wellbore formed of each rock type, on this basis. Again, the proportion of each rock type may be assessed according to the number of data points, out of the total number of data points for the interval, for which each rock type is identified. (For the present purposes, only a single rock type should be associated to each data point, although a more complex model may be employed where two or more rock types may be apparent at some data points from the lithology trace or associated measurements.) A more accurate representation may again, in principle, be obtained by instead calculating a length-weighted value of the rock type distribution, in a similar method to that explained above in respect of the distribution of the drillability parameter values. That is to say that, for each rock type, the sum of the length values for each data point is calculated and divided by the total length of the interval, to derive the percentage of each rock type within the interval, or, if preferred, only the percentages for the rock types which are problematic to the durability of the drill bit or another drill bit configuration performance parameter.

Moving to step 280, the effective drilled length for the drill bit configuration is calculated by multiplying the total length of the interval by the percentage of the problematic rock type in the interval. In the simplest way, this can be done simply by adding the percentages of each problematic rock type together, and multiplying the total by the length of the interval. A more meaningful measure of the effective drilled length for the drill bit configuration may also be obtained by applying a weighting factor to each rock type. For example, if one rock type is determined to have twice as much effect on drill bit wear as another rock type, the percentage of the most-wearing rock type may be taken directly, whilst a factor of 0.5 (or 50%) may be applied to the percentage of the less-wearing rock type. The result is a calculated effective drilled length which will permit a meaningful assessment of the performance of the drill bit configuration for drilling the interval. In particular, this assessment will permit a meaningful analysis of the degree of bit wear within the interval, and an assessment of the overall or effective rate of wear for the drill bit configuration within the interval, which accounts for the different degree of wear caused by each rock type.

Depending on the effective drilling performance parameter to be assessed, other drillability or drilling performance parameters can be used to determine the appropriate weighting factors to be applied. For example, the average rock strength for each type of rock may be used in setting the weighting factors applied in determining the effective length drilled in one rock type. Equally, the weighting factors may be based on the measured weight on bit (WOB), rate of penetration (ROP), bit rotation speed (bit RPM), etc.

Moving to step 290, an average ROP for the interval is calculated, in the same way as mentioned above. The ROP may be an average for the interval as a whole, or may be the average ROP obtained within one or more of the different types of rock identified within the drilled interval. Likewise, the average ROP may be calculated for each rock type individually, or for all of the problematic rock types together. In situations where there are multiple rock types present at particular depth intervals, the mixed rock-type data points can be excluded from the analysis, or an appropriate weighting scheme can be developed, for example to allocate an effective ROP to the drilling of an equivalent length of formation to each rock type, based on the proportion of each rock type.

Figure 4:
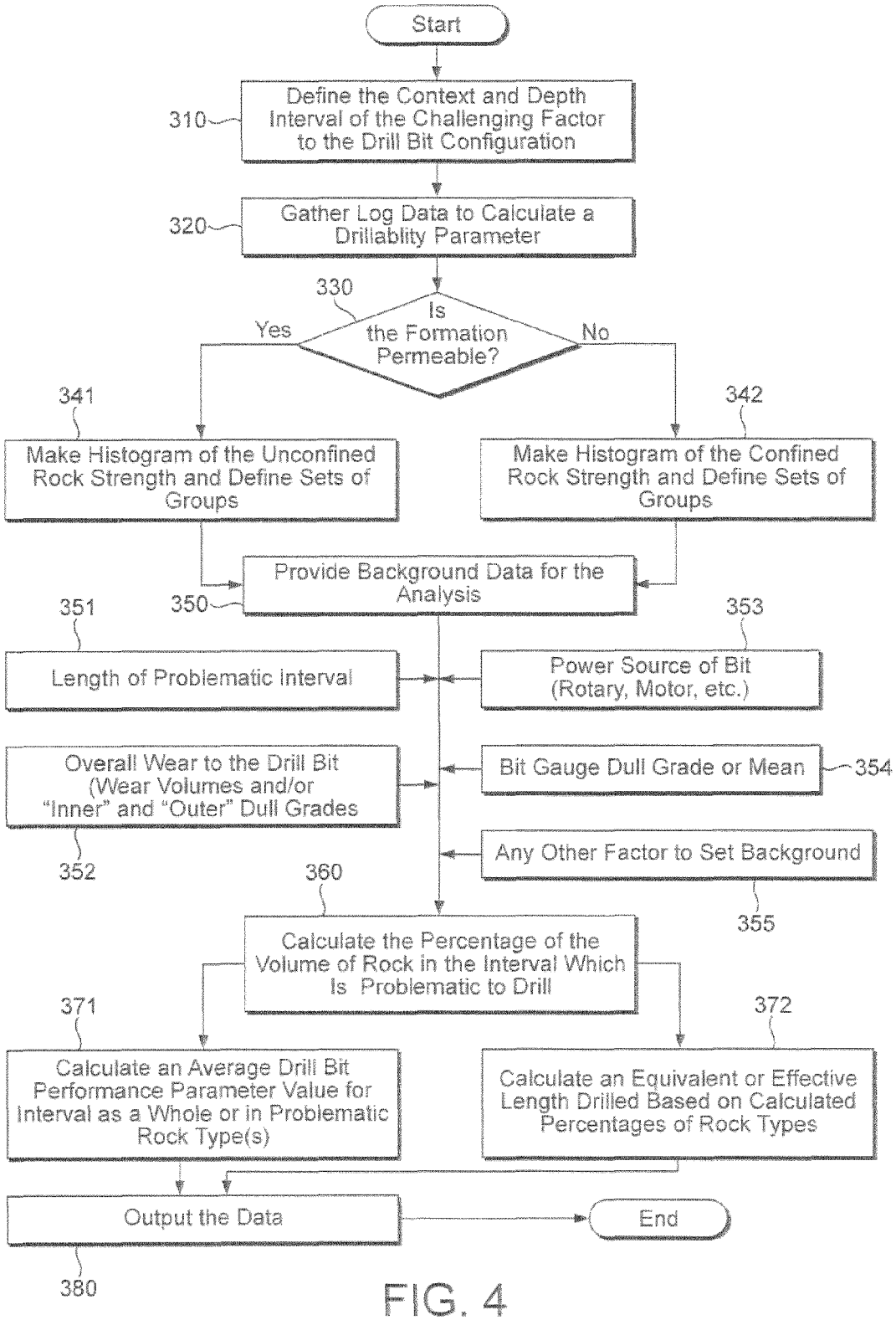
FIG. 4 shows a flow diagram for yet a further embodiment according to the present invention.
Figure 5A:
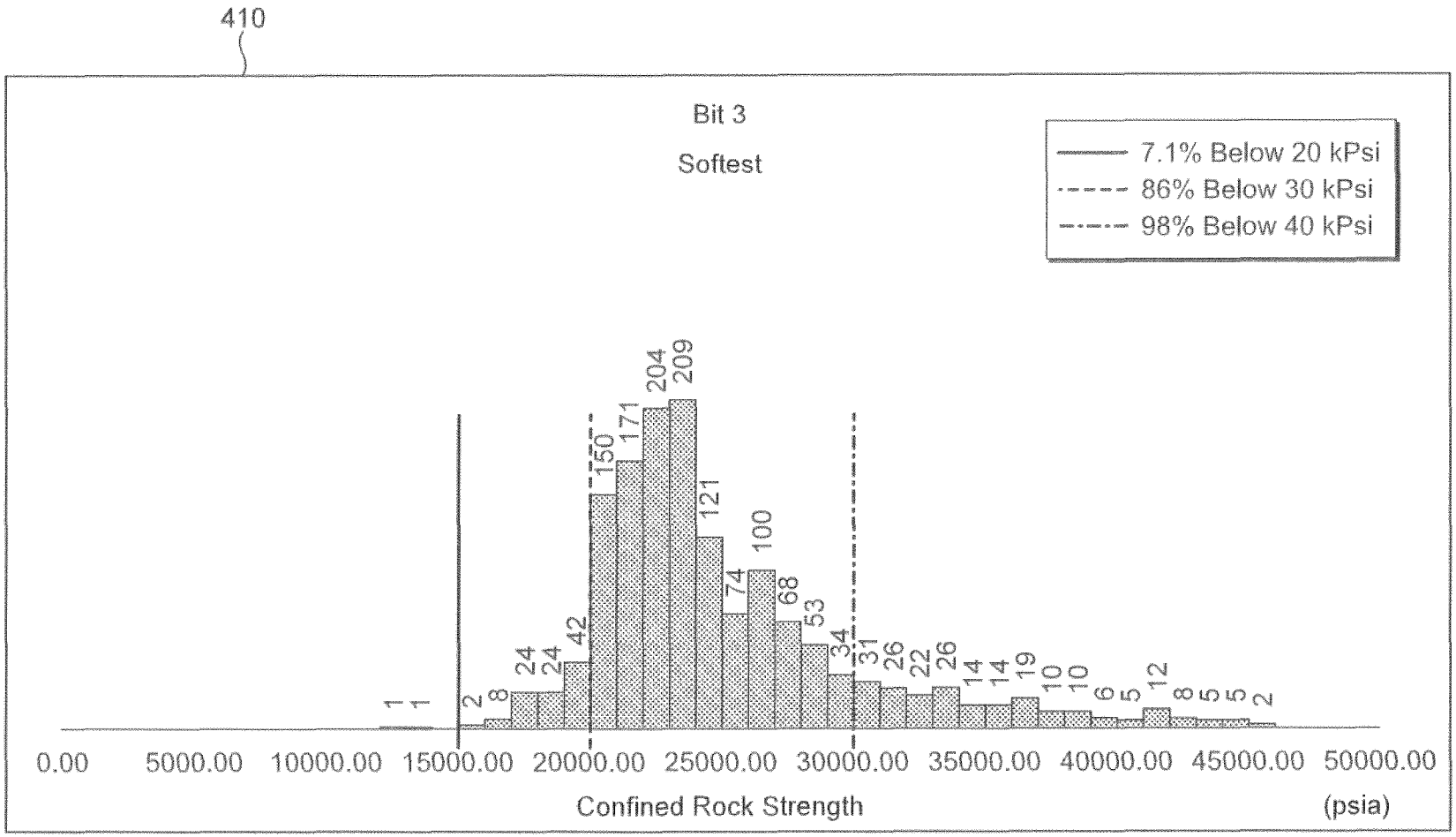
FIGS. 5A to D show an example of comparative confined rock strength distribution histograms for four different drilling intervals drilled by similar drill bit configurations.
Figure 5B:
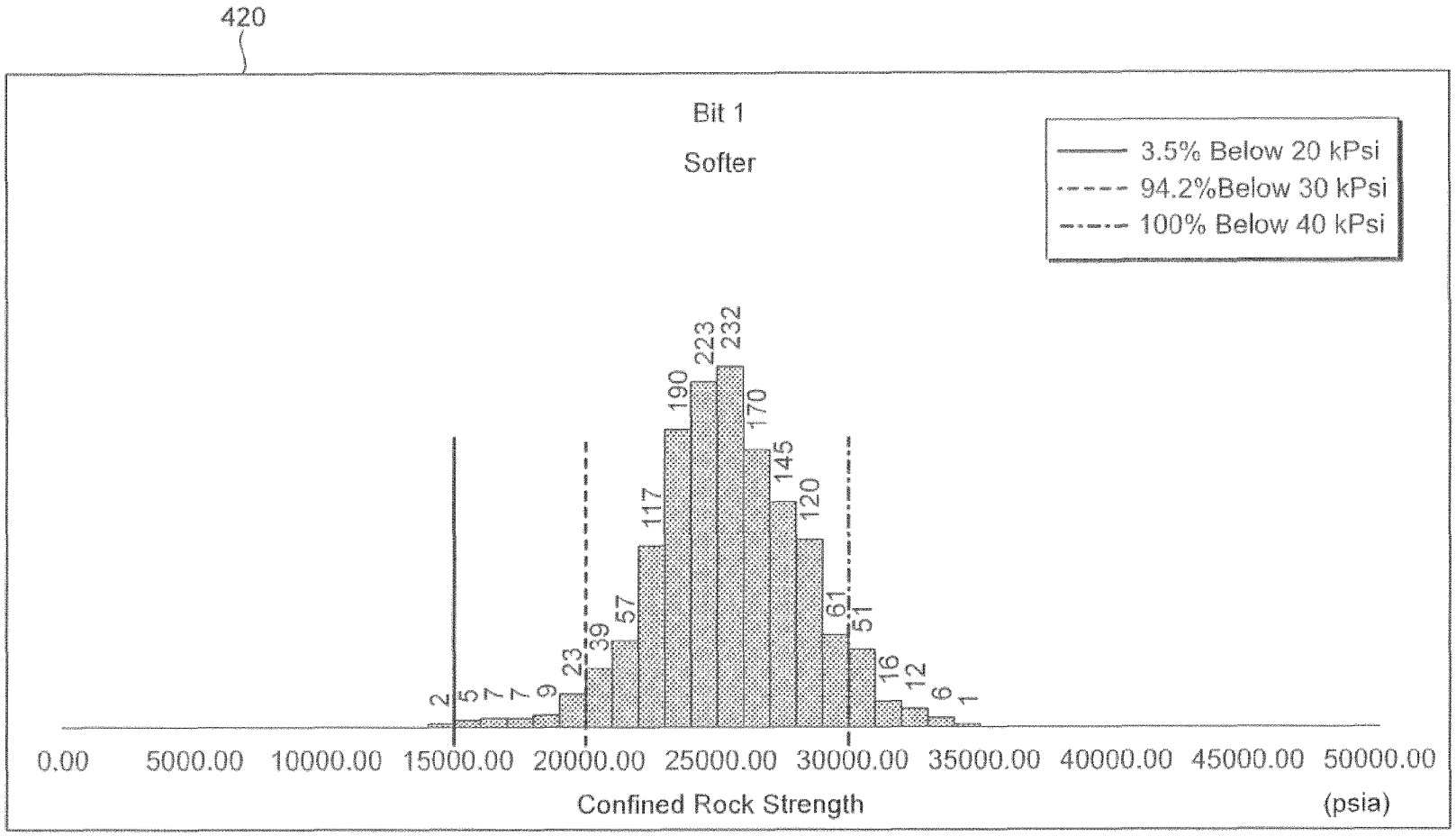
Figure 5C:
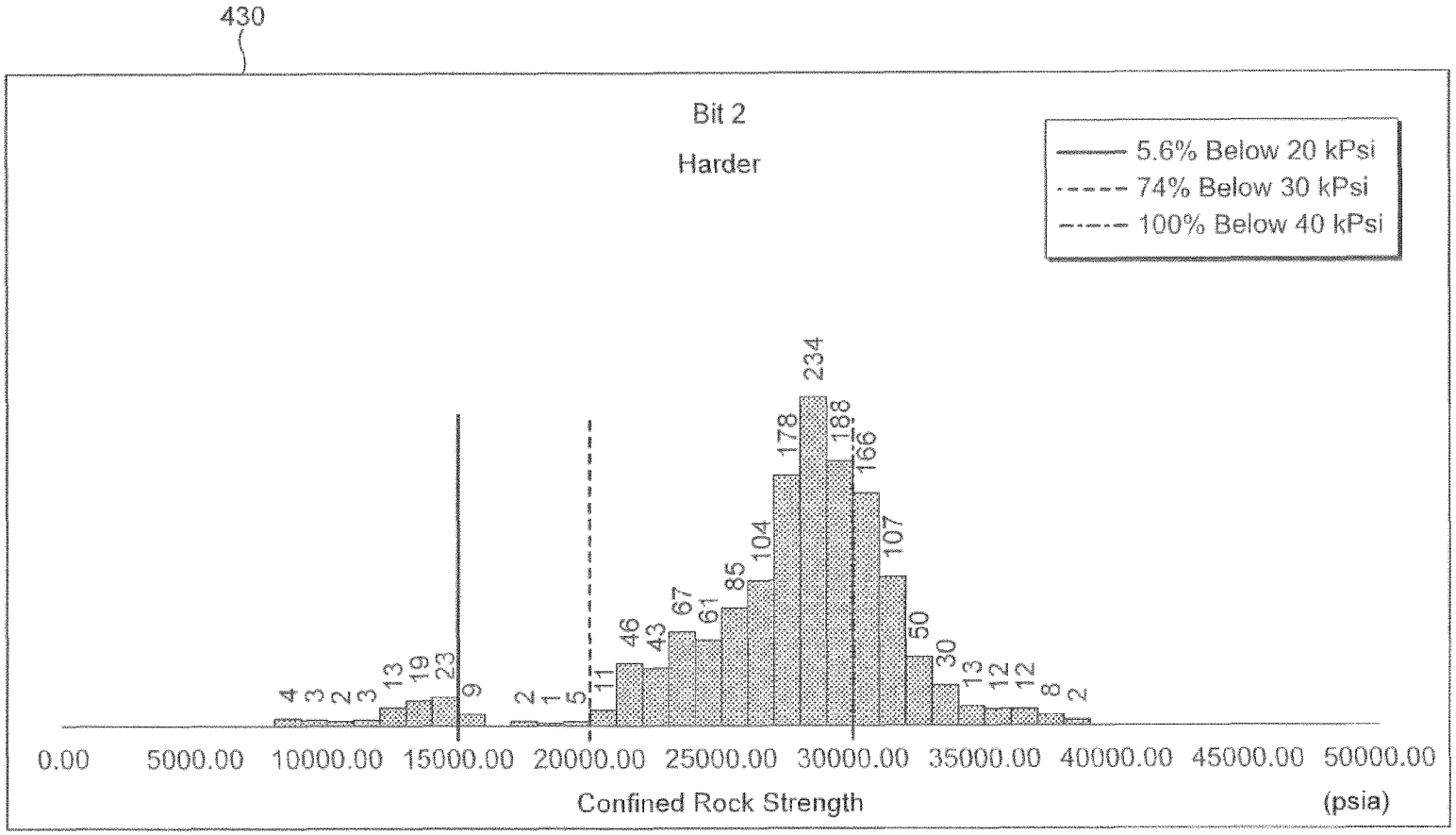
Figure 5D:
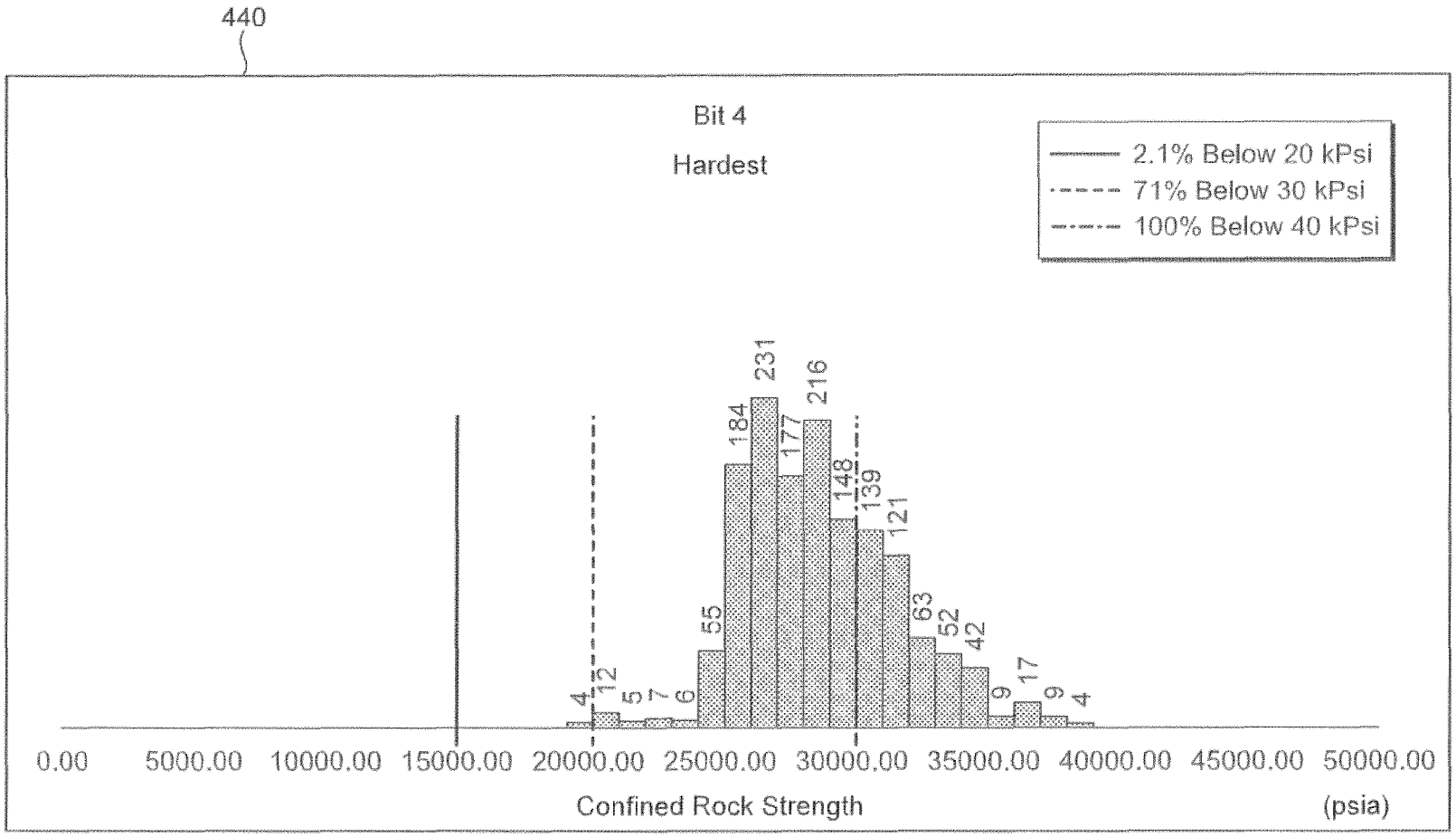
Figure 6A:
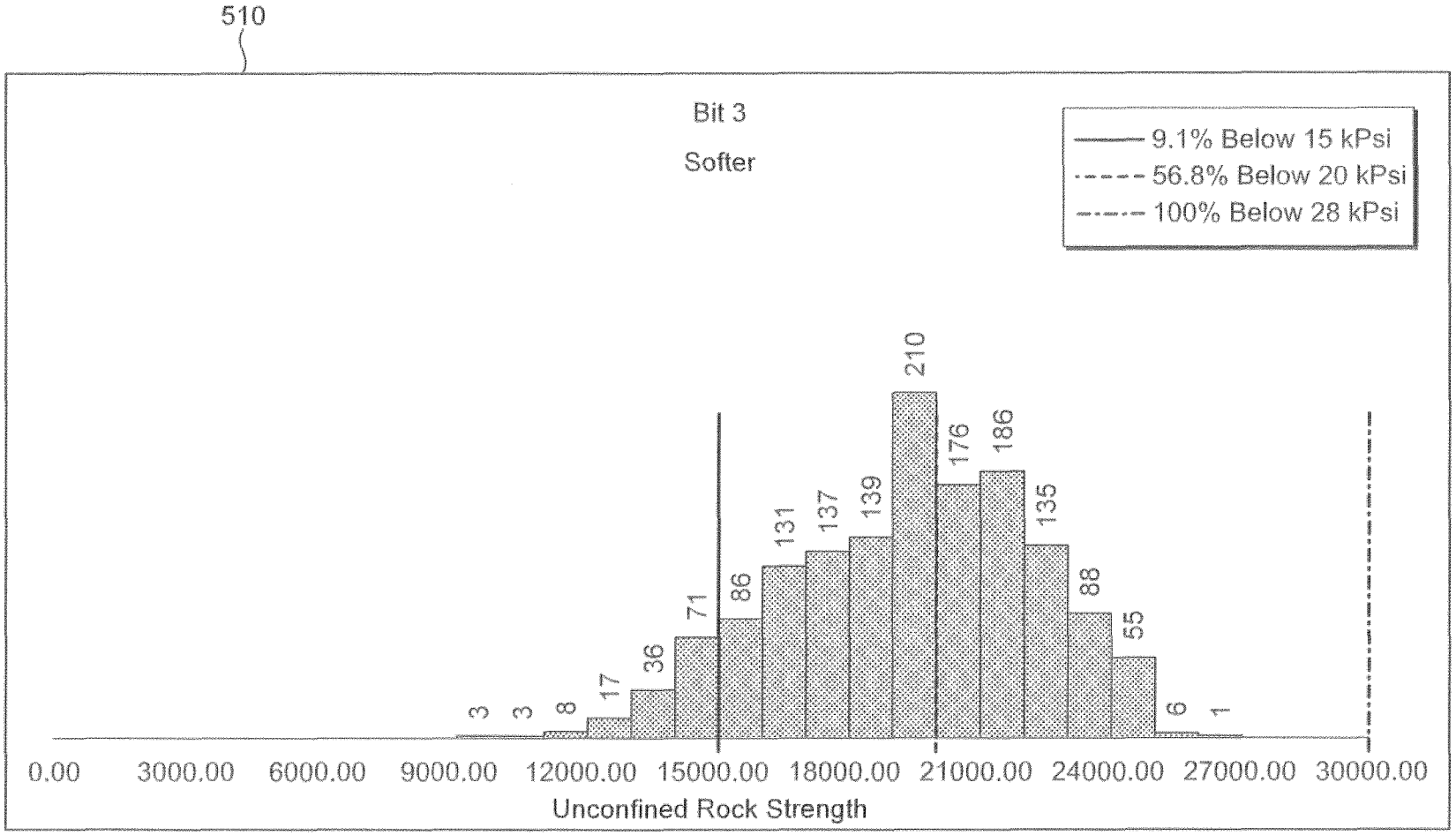
FIGS. 6A to D show comparative unconfined rock strength distribution diagrams for four different intervals drilled by similar drill bit configurations.
Figure 6B:
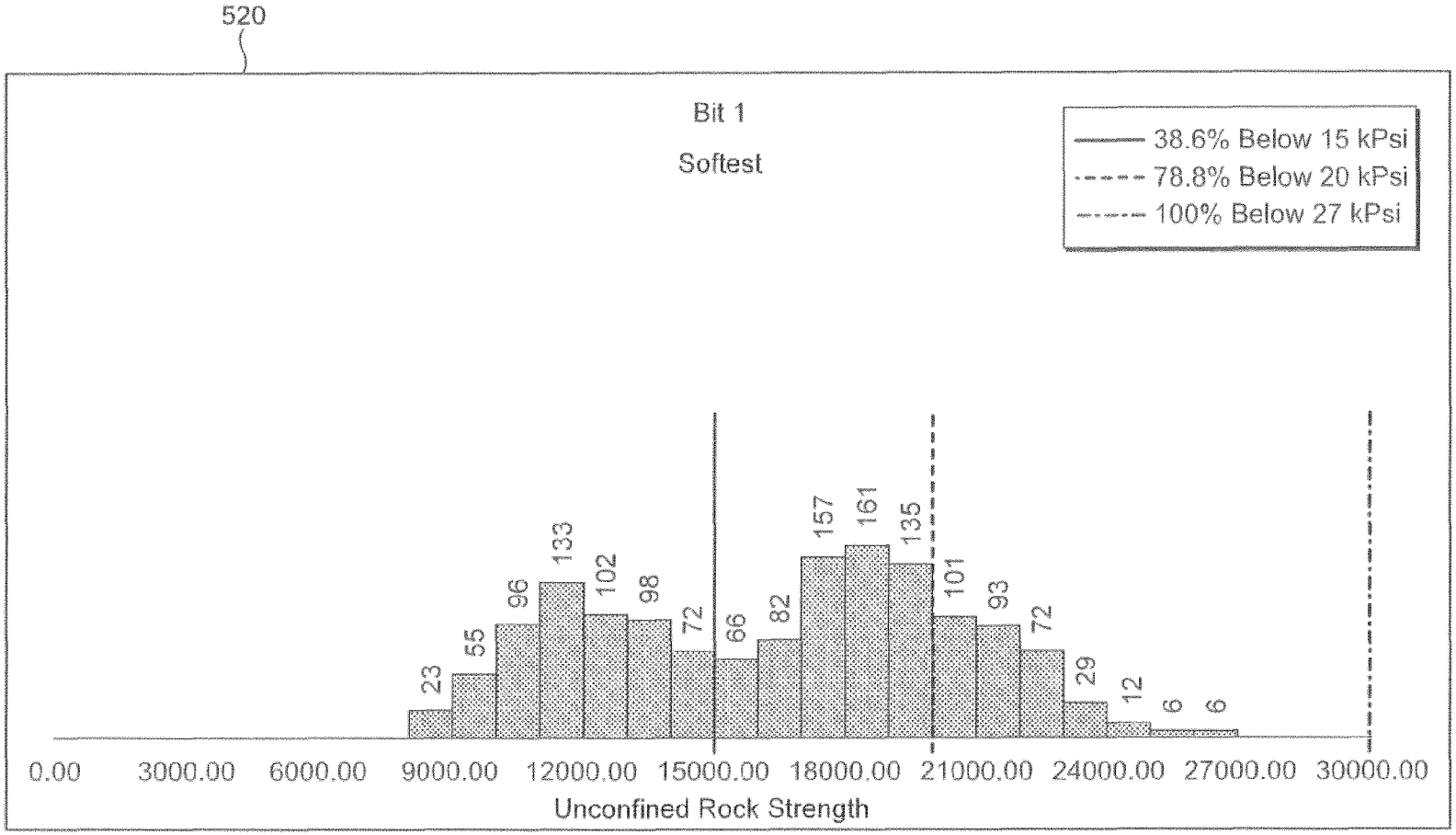
Figure 6C:
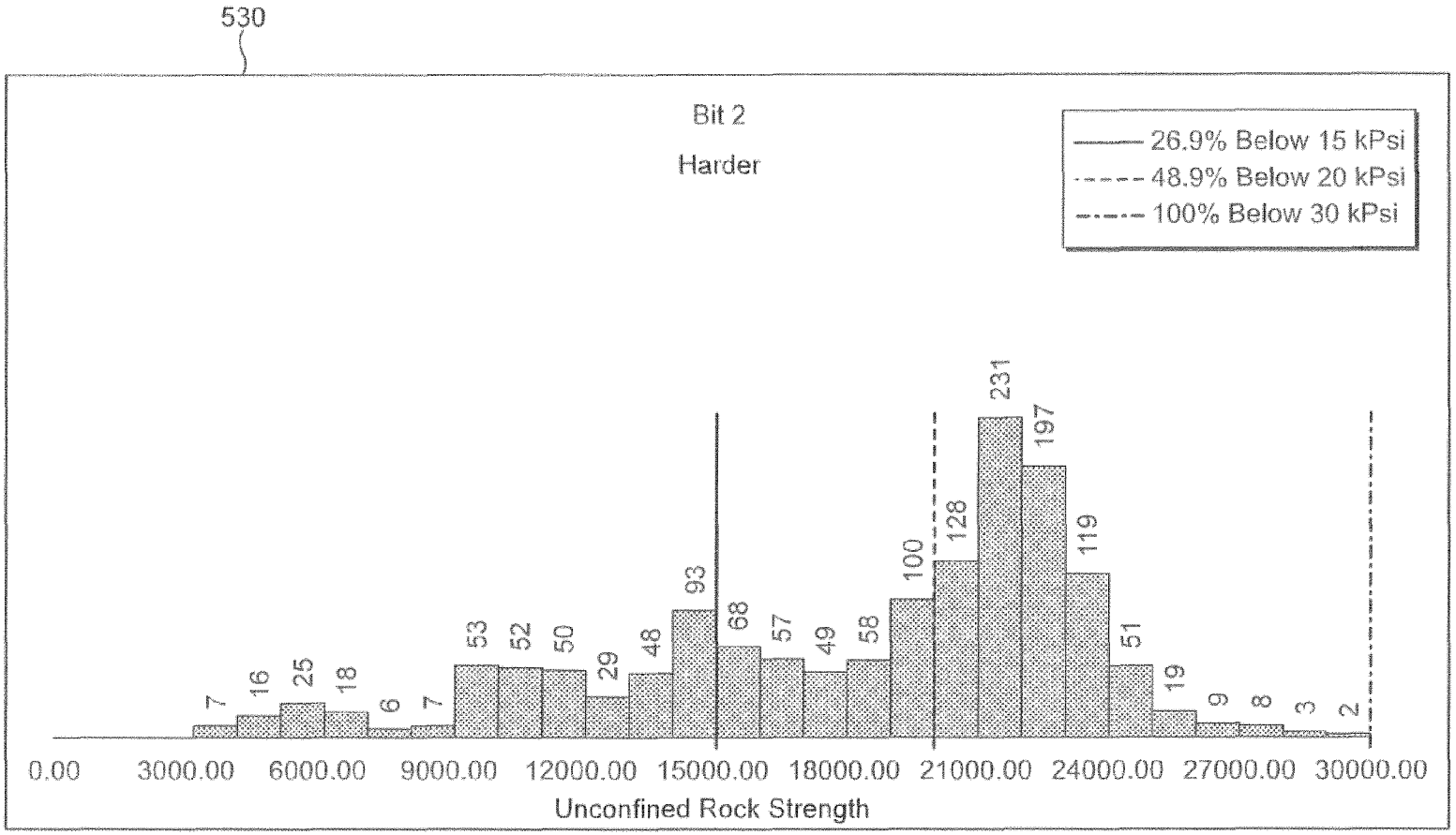
Figure 6D:
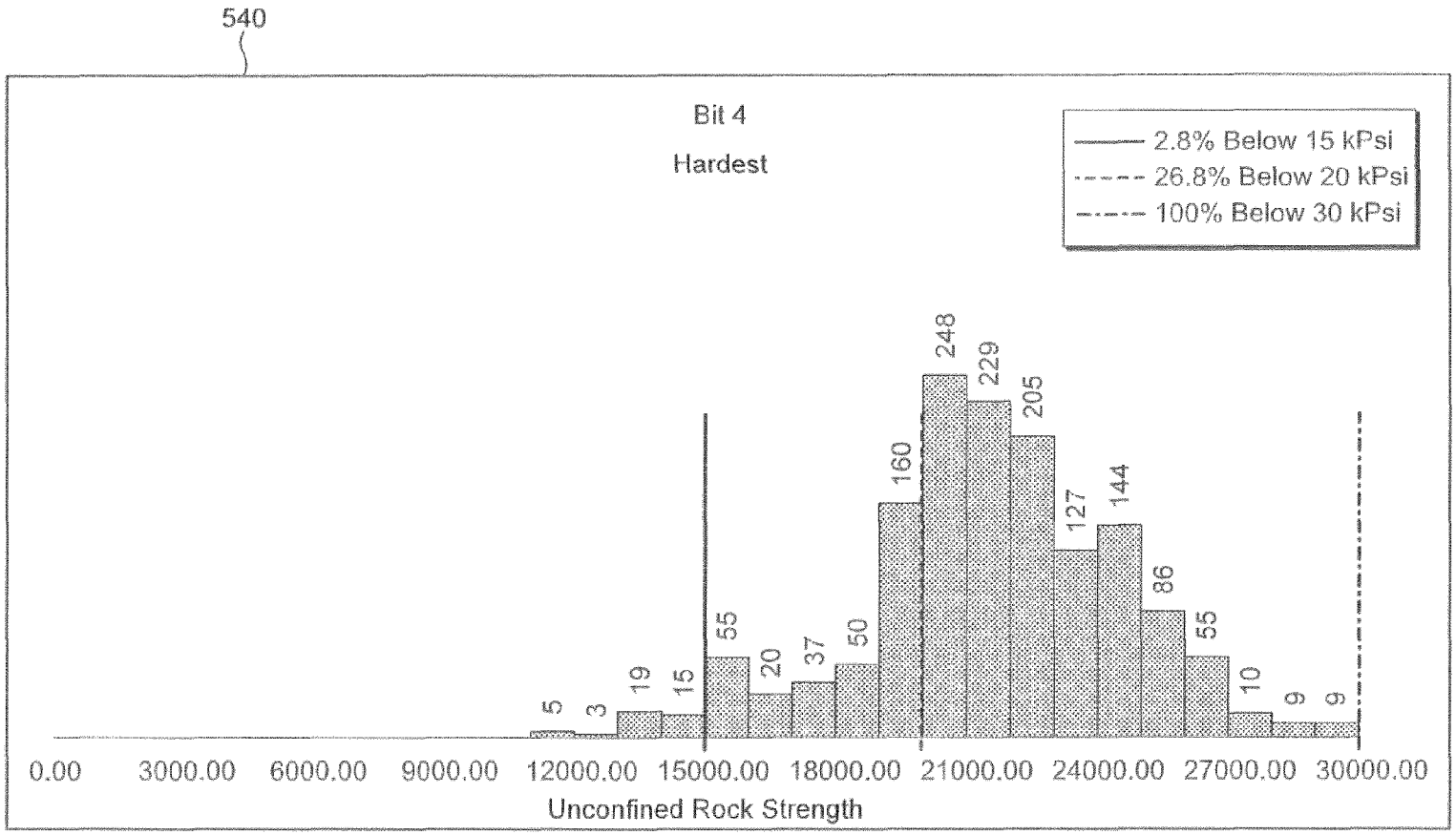

A method for assessing the drilling performance of a drill bit configuration is further exemplified in FIG. 4. The following discussion of the method of FIG. 4 is equally applicable to the methods shown in FIGS. 2 and 3.

In step 310, the context for the assessment is defined, by specifying any factors influencing drill bit performance dramatically, and by defining the depth interval of the challenging portion of the formation that has been drilled. In situations where more than one drill bit has been used to drill the interval, the start and end points of the portion of the run done with each drill bit is also defined.

In step 320, log data is gathered to calculate the confined rock strength. As mentioned above, two ways of calculating the rock strength include a calculation based on depth based gamma ray, density and neutron porosity measurements and, alternatively, a method based on gamma ray and sonic DTC curve values.

Further log data may also be gathered, including depth based rate of penetration (ROP), weight on bit (WOB), torque, and bit RPM (revolutions per minute). The gathered log data may also include depth based equivalent circulating density (ECD), and/or depth based mud weight in. The data may also include measurements of the pore pressure and formation tops (the depths at which the formation through which the wellbore being drilled changes from one rock formation to another).

At step 330, it is determined whether the formation through which the interval to be investigated is being drilled is permeable.

In step 341 or 342, either the unconfined rock strength or the confined rock strength, respectively, is calculated in dependence on whether the formation is permeable, and a histogram is plotted of the relevant rock strength distribution within the interval. As noted above, the rock strength is not the only drillability parameter of interest, and, as an alternative to steps 341 and 342, it may be informative to plot a histogram of alternative parameters, such as WOB or bit RPM. Equally, an alternative output format may be used to describe the drillability parameter distribution, and alternative plot types or a numerical description may equally be used. An alternative graphical representation may be plotted, in place of or in addition to, such a histogram. For example, as discussed with respect to FIGS. 7A and B below, an accumulative (cumulative) value of a drillability parameter, such as unconfined or confined rock strength, may be plotted against the depth drilled.

In step 350, background data for the analysis of the interval is provided. Examples of data to be included are shown as the length drilled including only the problematic interval, at step 351; the overall wear to the PDC cutter drill bits (measured wear volume, and optionally any "inner" and "outer" dull grades), at step 352; a definition of the power source of the bit (such as rotary, motor, etc), at step 353; the bit gauge dull grade or wear, at step 354; as well as any additional factors needed to properly characterize the drilling of the interval, at step 355. Further input data might include, for example, any run comments taken from the directional drilling (DD) report, information from the drilling operator's reports, seismic survey data, etc.

At step 360, the percentage of rock volume for each rock type which is a problem to the durability or performance of the drill bit configuration is calculated. As explained above, the rock types can be interpreted from the lithology report typically forming part of a well drilling log. The rock types can be identified using the SPARTA™ equipment, and the percentage of each rock type can be determined using statistical tools, such as the well known INSITE™ software, both provided by Halliburton Energy Services, Inc.

In step 371, the average ROP is calculated over the interval as a whole, as described above. Alternatively, the average ROP only for the parts of the interval corresponding to the problematic rock type or types can be calculated. In alternative applications, other drillability or performance parameters may be calculated as an average, instead of the ROP.

Additionally, in step 372, the equivalent length drilled through in the problematic rock or rock types is calculated, in a similar manner to that noted above.

In step 380, the calculated data is presented graphically, and may be included in a drilling analysis report, appropriately characterizing the performance of the drill bit configuration during the problematic or challenging interval, including any indication of reasons for above- or below-expected performance.

It should also be noted that, in this and the preceding methods, different rock characteristics may be relevant to different drilling parameters, and, therefore, it might be decided to assess rate of penetration against all rock types having a rock strength above a minimum value, but to assess the effective drilled length and/or the extent of bit wear against only the rock types which are known to cause drill bit wear.

Turning to FIGS. 5A to D and 6A to D, examples are given of confined and unconfined rock strength distribution histograms, respectively. The confined rock strength should in general be used, as it gives a more accurate reflection of the drilling interaction between the drill bit configuration and the formation rock. However, in permeable formations then the unconfined rock strength gives a good approximation of the confined rock strength.

The plots of FIGS. 5A to D and 6A to B are made for similar drilling intervals in the same rock formation, so that one might intuitively expect the drillability across the intervals to be broadly similar. However, the histograms show that that is not wholly true.

To aid in the visual assessment of the rock strength distributions in each of the tour histograms 410, 420, 430, 440 of FIGS. 5A to D, and in the four histograms 510, 520, 530, 540 of FIGS. 6A to D, boundary lines have been drawn at 15 kPsi, 20 kPsi and 30 kPsi on each rock strength distribution plot. These boundary lines divide the groups of calculated rock strength values for the data points within each interval into different sets.

With reference to FIGS. 5A to D, showing confined rock strength distributions, it can be seen that the rock strength distribution 410 has a large proportion of rock with a strength value between 20 and 25 kPsi, but with some extremely high rock strength portions of the interval, up to 46 kPsi. It is the only one of the four distribution plots with any calculated rock strength values greater than 40 kPsi.

By comparison to the rock strength distribution plotted in histogram 410, the rock strength distributions of histograms 420, 430, 440 are relatively more concentrated around one particular rock strength value. In histogram 420, the majority of the rock strength values are between 22 and 28 kPsi, centered on around 26 kPsi. By contrast, the distributions in histograms 430 and 440 are centered on slightly higher values, with the distribution in histogram 430 having the majority of values between 26 and 32 kPsi, centered on 28 kPsi, and with a substantial number of values in excess of 30 kPsi. Similarly, in histogram 440, the distribution is concentrated between 26 and 32 kPsi, although with a higher percentage of the interval having a confined rock strength above 30 kPsi.

In this way, it can be seen that it is possible to characterize the overall rock strength, or hardness, in each of histograms 410, 420, 430, 440 as, in that order, increasing. Thus, the interval corresponding to histogram 440 would be the hardest to drill, followed by the interval corresponding to histogram 430 and then that of histogram 420. With regard to histogram 410, the overall lower rock strength makes the interval as a whole easier to drill, but the effect of the very hard sections of the interval makes it possible to explain why the overall performance, in terms of rate of penetration and drill bit wear, might appear different than expected for such a drill bit configuration in a drilling interval with the same average confined rock strength.

In FIGS. 6A to D, the unconfined rock strength distribution has been plotted for the same four intervals, with histograms 510, 520, 530, 540 corresponding, respectively, to histograms 410, 420, 430, 440 of FIGS. 5A to D. Here, the histograms 520, 530, 540 show a corresponding trend in the hardness of the rock as for histograms 420, 430, 440, with histogram 540 representing the hardest rock, histogram 530 the next hardest rock and histogram 520 the softest rock. However, a different overall impression is given when comparing the histograms 510 and 520 as for that obtained by comparison of histograms 410 and 420. The confined rock strength distribution in histogram 420 suggests that the rock interval corresponding to histogram 420 is harder than the rock interval corresponding to histogram 410. By contrast, the distribution in histogram 510 suggests that this corresponds to a rock interval which is harder than the interval for histogram 520.

It will therefore be appreciated that, in order to obtain a meaningful comparison between the performances of the drill bit configurations used in drilling each respective interval, it is necessary to identify the appropriate drillability parameter which has to be taken into account. Typically, the confined rock strength will give a more accurate picture of the actual drilling conditions encountered during the drilling of the interval, although the unconfined rock strength values will give a good approximation of the actual drilling conditions for a permeable formation.

In the case of each of the histograms 410, 420, 430 and 440, as well as the respectively corresponding histograms 510, 520, 530 and 540, the measurements used to produce the histograms correspond to a 150 m interval drilled using an 8½ inch drill bit configuration, in each case. As a different drill bit was used to drill each of the respective intervals corresponding to histograms 410, 420, 430 and 440 (and equally corresponding to histograms 510, 520, 530 and 540), these obtained rock strength distribution plots allow variations in the performance between the drill bit configurations used in each case to be more properly understood, and any acquired drill bit performance parameter values to be placed in appropriate context.

In the foregoing, the rock strength distribution has been used as an example of a drillability parameter, which permits an assessment of the relative degree to which the formation resists drilling and can be characterized as a "problematic" formation type or rock interval. Various other indicators of the drillability of the formation could also be plotted in order to characterize the drilling environment encountered by the drill bit configuration in the interval being investigated, or to supplement the rock strength distribution analysis, such as a plot of the weight on bit (WOB) and bit rotation speed (bit RPM).

In terms of the performance parameter to be assessed, examples have been given above of certain parameters which are useful to characterize the relative performance of the drill bit for drilling the identified problematic rock interval. These include the length drilled (or the effective length drilled in problematic rock types), the rate of penetration (ROP), the bit wear volume and the bit dull grade. Other performance characteristics can be obtained and measured in place of or in addition to any of these mentioned parameters, depending on the particular characteristics of the drill bit configuration which the analyst wishes to assess.

The methods of the present invention for assessing the drilling performance of a drill bit configuration include the step of determining rock characteristics for the interval. This may, of course, include determining drillability parameter values for the interval, or an assessment of the types of rock within the interval, or both.

In order to determine the rock types within the interval, and specifically to identify the problematic rock types, it is of course possible to identify the proportion of each type of rock based upon the lithology trace from a well drilling log. Equally, there may be other ways to distinguish between the different types of rock present in a formation, such as from seismic survey data.

On the other hand, the problematic rock interval to be investigated might be identified from an appropriate drillability parameter, for example by selecting any intervals of a formation with a confined or unconfined rock strength above a particular value. For example, with reference to the confined rock strength distribution shown in histogram 410 of FIGS. 5A to D, it would be possible to identify any intervals within the well logging data where the confined rock strength exceeds 40 kPsi. Any such intervals could then be investigated, regardless of the type of rock having such a high apparent confined rock strength.

In the methods described above, it is, of course, possible to identify the proportion of each rock type within the interval, and thereby to eliminate from the final assessment of the drilling performance of the drill bit configuration any drilled portions of the interval which do not correspond to the problematic type of rock. On the other hand, it is not necessary in every case to actually determine the proportion of the rock type in question. Since the rock type for every data point in the well drilling log is known from the lithology trace, or otherwise, it is possible simply to select the points corresponding to the desired type of rock. Equally, once the confined or unconfined rock strength has been calculated, it is possible simply to select for assessment those particular data points falling within a defined set or group which one wishes to analyse. Equally, when selecting the data points for analysis based on a drillability parameter, it is not always necessary to determine the distribution of the drillability parameter values, and instead data points can be selected according to whether the specific measured or calculated value at that point meets one or more criteria, such as being above or below a given threshold.

Equally, when determining an overall drill bit performance parameter for the drill bit configuration, it is possible to apply any weighting factors to the individual specific data points, rather than applying them to the calculated percentage of each rock type, or to each set or group of data points corresponding to a particular drillability characteristic.

By way of example, in a formation including four rock types A, B, C and D, where A causes the greatest amount of wear of the drill bit and D has a negligible effect on the degree of wear incurred by the drill bit, whilst B and C influence the wear rate of the drill bit but to a lesser extent than rock type A, then appropriate weighting factors could be applied rock types B and C, for example of 30% in each case. For rock type A, the weighting factor to be applied is 100%. The data points for rock type D can either be ignored entirely, or can be included in the calculation but have a minimizing weighting factor, or even a weighting factor of 0, applied to them.

The respective weighting factor can be applied to each individual drilling performance parameter value to be assessed, for example, the length drilled through each rock type, to give an overall effective length drilled. By applying the weighting values mentioned above in this particular example, the effective length drilled would correspond to an effective length drilled in the rock type A. In a 100 m interval, where an equal proportion of each rock type is present, the effective length drilled is thereby determined as 25 m×100%, for rock type A, plus 25 m×30%, for rock type B, plus 25 m×30% for rock type C, with rock type D being ignored. This gives an effective length, equivalent to drilling through rock purely of type A, of 40 m.

The effective or equivalent length drilled can thus be said to be normalized to rock type A. By applying a different set of weighting criteria, the values could be normalized to any one of the other rock types B, C or D. Note that, in this way, the effective length drilled might correspond to a value greater than the actual length of the interval being investigated, since the weighting factor to be applied to a particularly abrasive rock type might be larger than 100% where the effective length being assessed corresponds to a less abrasive rock type.

The above example is useful when attempting to determine the effective durability of a drill bit, and the degree to which it wears when drilling through problematic rock formations of a particular type. Other drillability and drill bit performance parameters may of course be normalized in a similar manner, depending on the particular characteristic of the drill bit configuration being investigated.

Appropriate weighting factors may be selected by the analyst investigating the performance of the drill bit configuration, based on experience gained of drilling through different types of rock in other formations. Where direct comparative data is available for determining the effective wear rates produced by different types of rock with any particular drill bit configuration, then of course the weighting factors can be adjusted to reflect more closely on real life observations.

In a similar way, such weighting factors can by applied when assessing an average performance parameter value, in order to give a meaningful effective average value regardless of the distribution of the rock strength or other drillability parameters and drilling conditions.

For example, it could be determined that the wear rate experienced by a drill bit increases exponentially with the confined rock strength of a rock being drilled. In this case, it may be appropriate to adjust the incremental length allocated to each data point when assessing the total effective length drilled, based on the rock strength at that data point. The effect of such weighting factors will, in general, be to normalize the performance of the drill bit according to one particular rock type and/or according to one particular drillability characteristic of rock within the interval being investigated.

As noted above, the weighting factors to be applied may be informed by empirical data, or by reference to other measured or calculated drillability or drilling performance parameter values. The weighting factors may even be determined based on multiple different drillability and drilling performance parameters, or based on specific relationships between multiple different drillability and drilling performance parameters. It goes without saying, however, that, where appropriate in view of the accuracy required, the weighting factors may equally be selected by the analyst based on his or her experience and knowledge of the same or related geological formations.

As will be apparent from considering FIGS. 5A to D and 6A to D, the method of assessing the performance of a drill bit according to the present invention also allows a comparison to be made between different drill bit configurations, including between different types of drill bit. Although such analysis will typically be conducted retrospectively, the main purpose of such analysis is to inform the future design and selection of drill bits for drilling in a particular formation or rock type.

In some cases it may be possible to directly, quantitatively assess the respective performances of different drill bit configurations where the drillability parameter values do not exhibit a significantly different distribution within the respective intervals, or providing that a sophisticated scheme of appropriate weighting factors is applied in the analysis of the drill bit performance parameter or parameters to be assessed.

In general, however, it will often not be possible simply to identify a single drill bit performance parameter value for direct comparison, due to the multiple different factors which affect drill bit configuration performance in a real-life drilling environment. For this reason, the analysis method disclosed herein represents a particular tool which an analyst can use, together with their experience and associated drilling reports, to give a more meaningful interpretation of the respective performances of different drill bit configurations as used in similar formation intervals. For example, an analyst would be able to assess a combination of different drill bit performance parameters, such as average rate of penetration, effective length drilled and degree of bit wear, together with a rock strength distribution for one or more of the rock types within the interval, to provide an overall picture of the performance of each drill bit and to make relative comparisons between different drill bits used to drill different intervals.

For the purposes of the present description, it is assumed that the analyst will obtain depth based readings, measurements and calculations from a well drilling log. However, for present purposes, the source of the data to be analysed is unimportant, and it may be taken from a well drilling log or from any other available source (such as directly from measurement equipment). The term well drilling log should thus be interpreted to encompass any series of depth based measurements or calculated parameters values which give drill bit performance, drillability and/or rock type information at multiple data points along a wellbore.

Once a comparison has been made between different drill bit configurations, a drilling operator will then be able to select from the field-tested drilling configurations in order to drill a subsequent wellbore in the same or a similar formation, in particular in order to drill through an interval within a formation which has been identified as being likely to be problematic to drill. The present invention is particularly useful for assessing the performance of specialized drill bits, such as PDC cutter drill bits, which are chosen and used specifically for drilling through problematic formation intervals, and which are effective at cutting through the problematic rock types but may be prone to a high degree of bit wear resulting from the associated drilling conditions. For such types of drill bit, it is very useful to be able to make a relative, meaningful comparison in order to inform the selection or design of the drill bit configurations to be used in future to drill similar problematic formation intervals.

This is particularly useful in the situation of drilling multiple wells in a single well field, where all wellbores extend through broadly similar sections of formation, and where the experience gained from drilling earlier wellbores in the formation can be put to use when planning the drilling of further successive wellbores in the same formation. However, if any selection or redesign of drill bits is to have the desired effect of improving the real-life drilling performance in the successive wellbores, the basis for assessment and comparison of the drill bit configurations already tested in the field must take account of the differences and variations in the drilling conditions in which each of the respective drill bits has performed. This is made possible by the methods disclosed herein for assessing the performance of a drill bit configuration.

It will be appreciated, of course, that the analytical method described herein is, in general, to be carried out on a computer, with appropriate input from the analyst. In practice, all calculation and determination steps will be carried out by the computer processor, whilst the input of data will also typically be achieved in a computerized manner. In such a computerized system, the analyst may be responsible for setting, for example the values for the groups, as well as the division between sets, for the parameter values used in determining the drillability parameter distribution within the interval. However, these groups and sets may also be set automatically by the computerized system, without requiring input from the analyst. Equally, the step of assessing the effectiveness of the drill bit configuration for drilling the interval based on the determined drilling performance and the determined rock characteristics can be done by computerized processes by which an automatic assessment can be made.

Another computerized technique, for planning a well drilling operation, might involve the assessment of individual data points from the well drilling log or logs of one or more intervals drilled with respectively one or more drill bit configurations. Assuming that a wellbore drilling operation is planned, a series of data points can be defined along the length of the planned wellbore, and any expected difficult-to-drill intervals can be identified. For each of the data points within the interval to be drilled, a plurality of the most closely-approximating data points from the drilled intervals of the or each earlier drilled wellbore can be identified, based on common known characteristics identified for the planned wellbore, such as by seismic survey and other related measurements. By taking an average for all the similar data points in each already-drilled interval, an expected performance for each known drill bit configuration can be determined for each data point along the interval to be drilled. In this way, the expected performance of one or a number of different drill bit configurations can then be predicted, for the planned interval to be drilled, by extrapolation. The drill bit configuration to be used can then be selected, or the design of the drill bit configuration adjusted, accordingly.

A less complicated version of this method would simply be to determine the proportion of each rock type within the interval to be drilled, and thereby to obtain a predicted effective length of one or more of each rock type within the interval to be drilled. Knowledge of the effective drilled length for each of the investigated drill bit configurations can then be applied to the selection or design of the drill bit configuration to be used in drilling the planned wellbore interval to be drilled.

Figure 7A:
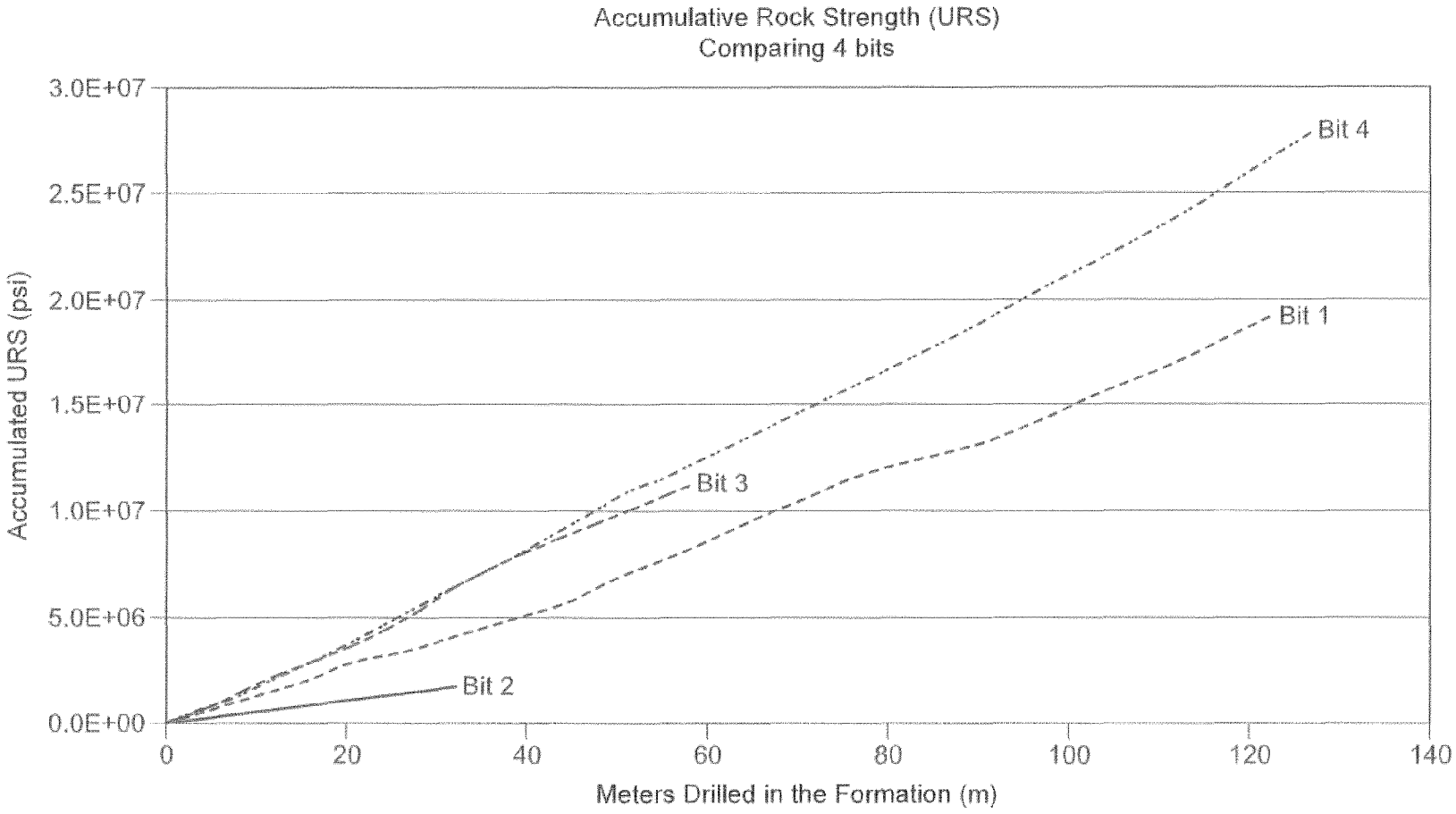
FIGS. 7A and B show plots of Accumulative Unconfined Rock Strength and Accumulative Confined Rock Strength, respectively, against Depth Drilled (length drilled) for four different drill bits in similar intervals in the same formation.

Turning to FIGS. 7A and B, another method for assessing the relative performance of several different drill bits in apparently similar sections of formation is shown.

FIGS. 7A and B show plots of the accumulative (or cumulative) rock strength (in the case of FIG. 7A, unconfined rock strength; in the case of FIG. 7B confined rock strength) against the depth drilled in the respective formation intervals, for four of the individual drill bits used in drilling the intervals shown in FIGS. 5A to D and 6A to D. These are labelled as Bit 1 to Bit 4 in each of the corresponding histograms 410, 420, 430, 440, 510, 520, 530 and 540, and next to the respective plot lines in FIGS. 7A and B.

The accumulative rock strength vs. depth is plotted for the length drilled by a single drill bit of each configuration, and shows the accumulated rock strength between the start and termination of drilling with each drill bit. This plot gives a good representation of the total work done by each drill bit in drilling into the formation. The slope of the plot for each type of drill bit also indicates how strong the rock is that is being drilled, with the steeper curves indicating drilling through rock of higher rock strength. (Of course, a single plot could be made for assessing the performance of any single drill bit, where a comparison between different drill bits is not required.) Changes in the slope of the curve are indicative of changing trends in the rock strength as the depth increases.

The plot may be derived simply by adding the measured rock strength value at each depth position to the sum of the values of rock strength at each preceding point, and plotting this against depth. This assumes, of course, that all data points are separated by an equal depth interval. In the plots shown in FIGS. 7A and B, all data points are 1 m apart, and so no length compensation needs to be applied.

Where the data points are not at fixed intervals, then the accumulative value can be obtained by multiplying the length interval by the rock strength value at each point, and summing this length-multiplied value for each of the points, in the same way.

As will be appreciated, FIGS. 7A and B shows only one particular pair of examples, using unconfined and confined rock strength, respectively, as the accumulative drillability parameters. Other drillability parameters may equally be plotted in the same way, such as, for example, weight on bit (WOB), speed of rotation of the drill bit (bit RPM), rate of penetration (ROP), which all give an indication of the effective effort being applied through the drill bit configuration into the formation.

FIGS. 7A and 7B again demonstrate the need to exercise scrutiny in selecting appropriate parameters by which to compare different drilling configurations in order to obtain a meaningful comparison. The plots of accumulative unconfined rock strength for each drill bit in FIG. 7A seem to show that, for the four drill bits under investigation, Bit 4 drilled the longest distance through the formation and also drilled through the hardest rock (highest unconfined rock strength rock). Bit 1 drilled nearly as far, but through less hard rock. Bit 3 drilled through rock with similar hardness, but only managed to drill a much shorter length. Bit 2 drilled through the softest formation, and also drilled the shortest length before being pulled out; however, in this case the drilling terminated before the drill bit was fully worn.

Figure 7B:
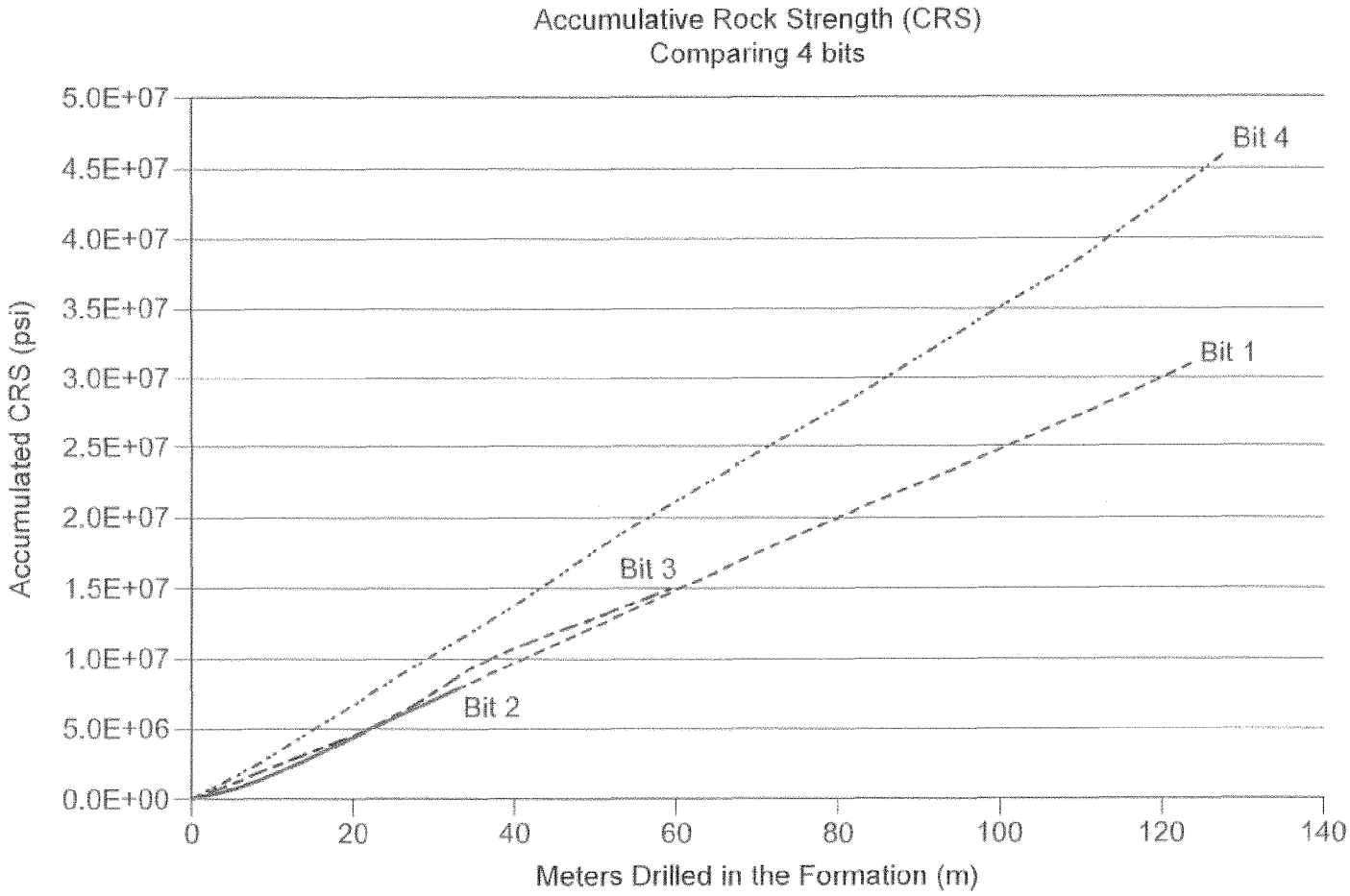

However, the plots of accumulative confined rock strength for each drill bit in FIG. 7B indicate that the three drill bits, Bit 1, Bit 2 and Bit 3, in fact, all drilled through formation of very similar effective hardness, with the slopes for these drill bits being very similar and directly comparable. This suggests that Bits 1 and 2 were in practice drilling through a somewhat relatively harder formation than suggested by FIG. 7A. FIG. 7B also confirms that the interval drilled by Bit 4 was indeed of significantly harder formation material than the intervals drilled by Bits 1, 2, 3 and 4.

Plots such as FIGS. 7A and B are useful in identifying which individual drill bit configuration performs best and most reliably for a given type of formation. Bits 1 and 4 can be directly compared in view of the similar lengths drilled, which would lead to the conclusion that Bit 4 performed better as it drilled further in harder rock. Bit 1 is likely to wear more quickly in harder rock, and so would probably not have drilled so far under the same conditions experienced by Bit 4. Similarly, it is likely that Bit 4 would have drilled further in the formation drilled by Bit 1.

Since, in any drilling operation, there is a significant cost associated with having to retrieve a worn drill bit and replace it, knowing which drill bit configuration can make best progress through hard, wearing formations allows an appropriate selection to be made based on knowledge of the actual past performance of other drill bit configurations under similar drilling conditions.

Even in this case, however, it will be clear that the four drill bits, Bits 1 to 4, were not drilling through a single type of rock. The accumulative drillability parameter may therefore be based only on those data points corresponding to problematic rock types, and ignoring the data points for rock types that are not relevant to the performance of the drill bit configuration. For example, following the examples given above, any data points consisting exclusively of shale could be ignored, and the accumulative value could be calculated using only those data points which include at least some sandstone. Alternatively, the accumulative value could be calculated using only the data points which exclusively consist of sandstone, or which include at least a minimum proportion of sandstone.

In any approach which includes data points where there are mixed rock types, the effective length drilled in the problematic rock type can be calculated as before, by applying a weighting factor based on the proportion of each rock type (either in the interval as a whole, or for each data point). Extracting relevant data for the effective or equivalent accumulative rock strength or other drillability parameter becomes more challenging where mixed rock types are involved, however, as the value calculated for each data point will be based on the average value for the different rock types encountered.

One way to approach this is to assume that the calculated rock strength is representative of the hardness of the mixed rock of either type, and that no adjustment is necessary. In this case, the effective or equivalent accumulative value of the drillability parameter is obtained by multiplying the actual calculated rock strength by the effective or equivalent length of the problematic rock type, as noted above.

Another way would be to assume a proportional relationship between the rock strengths of each type of rock, and to apply an appropriate weighting factor to the actual calculated rock strength, to give an effective rock strength for each rock type at each data point. For example, in a shale and sandstone formation, it might be concluded that the shale typically has a rock strength that is 5% lower than that of sandstone. In this case, the effective rock strength for each rock type can be calculated. Using the above example, with a mixture of 60% sandstone and 40% shale, assuming a calculated rock strength of 20.0 kPsi, the effective rock strength for sandstone would be calculated as 20.0 kPsi×1/(0.60 [the percentage of sandstone]×1.00 [sandstone rock strength weighting factor]+0.40 [the percentage of shale]×0.95)=20.4 kPsi. Of course, this is merely an exemplary calculation, and more complex and detailed relationships may be established based on empirical or other data, and may, for example, take account of the geological rock structure, changes in proportional rock strength with depth, etc.

Figure 8A:
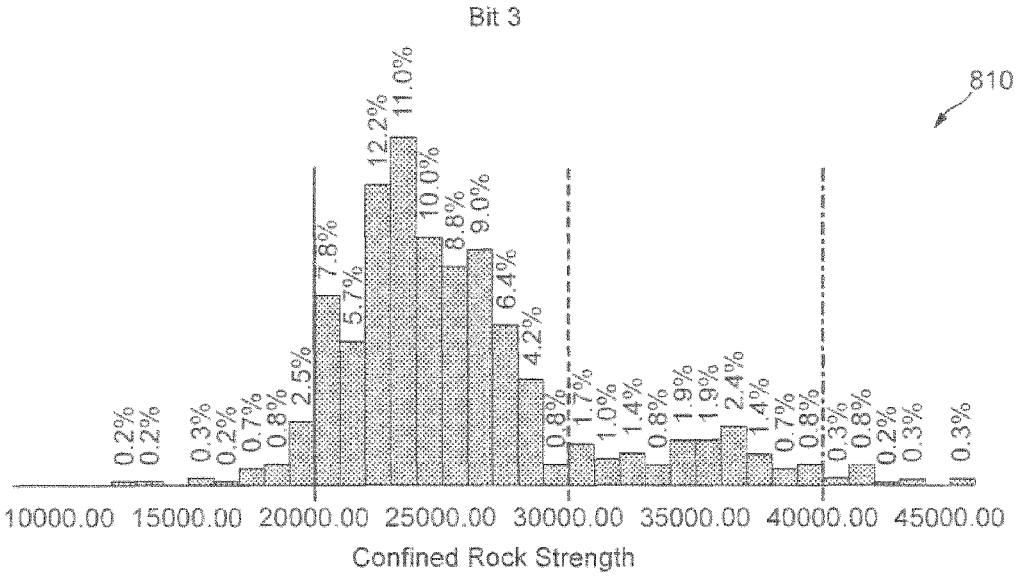
FIGS. 8A to D show comparative confined rock strength distribution diagrams for the four drill bits of FIGS. 7A and B, together with a table of related information pertinent to making an informed analysis and comparison of the respective drilling performances of each drill bit.
Figure 8B:
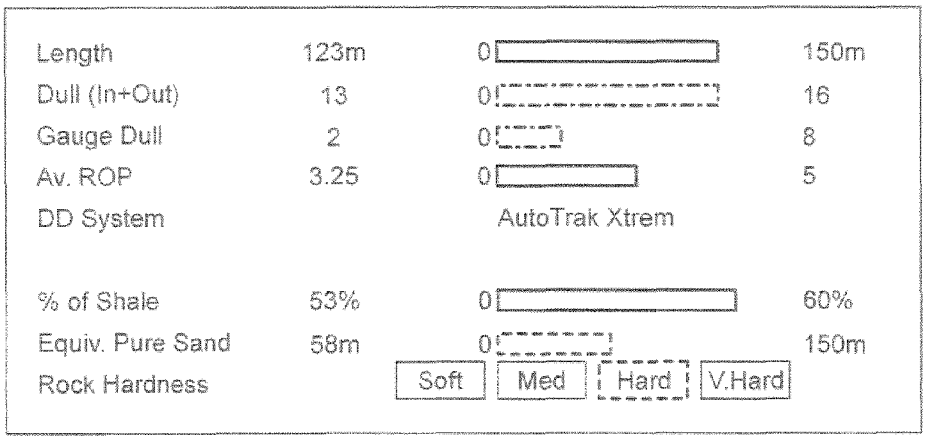
Figure 8B:
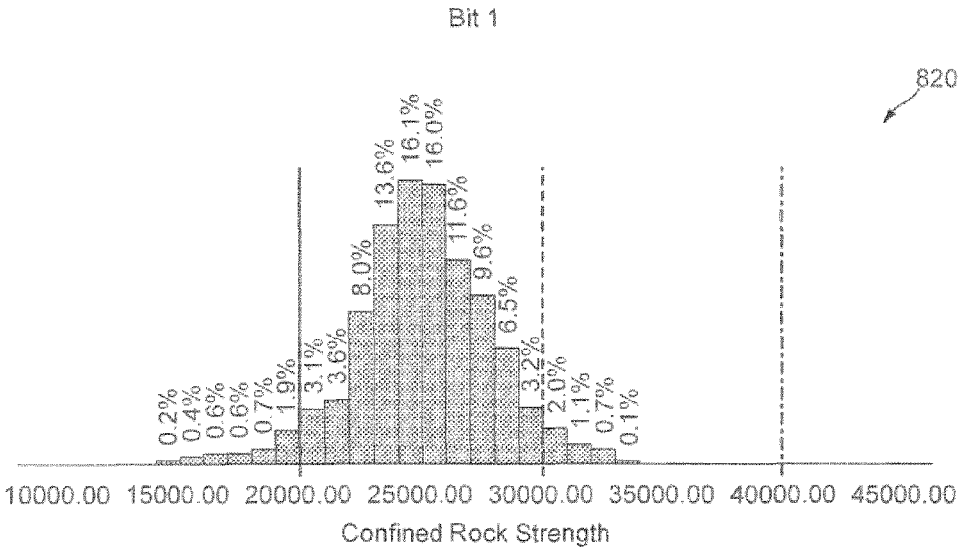
Figure 8C:
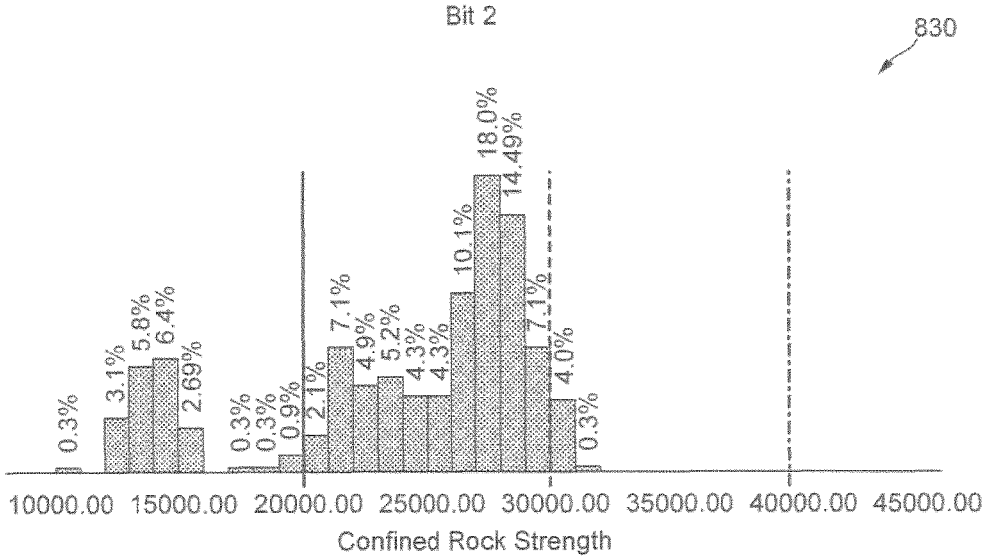
Figure 8D:
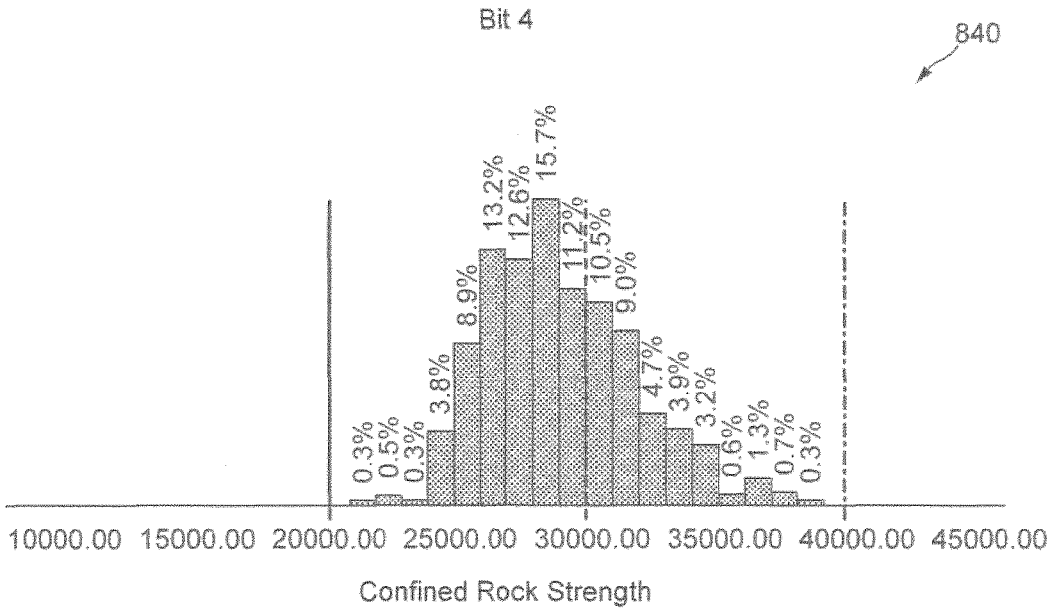

Turning to FIGS. 8A to B, examples are given of how the graphical representations may be taken together with other specific data relating to the drilling interval and drilling conditions, in order to provide a more informed overall assessment of the drilling performance of individual drill bit configurations, as may permit a more meaningful comparison between different drill bit configurations and different drill bits.

FIGS. 8A to D show the confined rock strength distributions for the four drill bits, Bit 1 to Bit 4, of FIGS. 7A and B, together with a table for each bit that gives pertinent data relating to the effective and overall performance of each bit.

The confined rock strength distributions 810, 820, 830 and 840 are notably different from the similar distributions 410, 420, 430, 440 in FIGS. 5A to D, as the distributions of FIGS. 8A to D relate only to portions drilled by a single drill bit, whereas the intervals 410, 420, 430, 440 of FIGS. 5A to D constitute the data points for 150 m intervals that may have been drilled using multiple drill bits (each of the multiple drill bits being used in identical drill bit configurations within each respective interval).

The tables in FIGS. 8A to D indicate, inter alia, the actual length drilled by each of the drill bits, Bit 1 to Bit 4; the extent of wear on each drill bit between start and termination of drilling with that bit, including dull grade and gauge dull grade; the average rate of penetration (ROP); the percentage of non-problematic rock within the drilled interval (in this case, the percentage of shale in a shale and sandstone formation); and the equivalent or effective length drilled in pure sandstone based on the above calculation where the total length drilled is multiplied by the proportion of sandstone, calculated as 100% less the percentage of shale). As noted above, drilling with Bit 2 was terminated before it became fully worn, as can be seen from the indication of dull grade. This indicates to the analyst that reference to the drilling operator's report is needed to identify why drilling with this bit was terminated. In particular, the rate of penetration was good, suggesting that the drill bit may have been pulled out due to bit failure or due to some external influencing factor not related to its drilling performance (such as pulling out due to associated equipment failure or adverse operational conditions, or due to reaching total depth).

This makes clear that a direct comparison between Bit 2 and the other bits may not be appropriate, but otherwise confirms the relative drilling performance of Bits 1, 3 and 4. In particular Bit 4 appears to have performed best at drilling through the hardest rock, while Bit 3 appears to have performed least well. This may indicate that further investigation of the very hard portions of the formation drilled by Bit 3 is needed, or that this bit should be re-designed to cope better with the harder sections of rock. Equally, a drilling operator could feel reassured in selecting Bit 4 in preference to Bits 1 and 3 for drilling similar intervals in the same or similar rock formations, when planning future drilling operations. A comparison between Bits 1, 3 and 4 may also help to inform future drill bit design, as the variation in respective performance can be compared with the location and extent of wear on each drill bit to identify specific areas for re-configuration.

The graphical representations of FIGS. 8A to D may be viewed in conjunction with the plots of FIGS. 7A and B to give a robust appreciation for the overall drilling performance of each of Bits 1 to 4. In particular, FIGS. 7A and B help to qualify the extent to which the relatively small proportion of some relatively high rock strength sections of the drilled interval affect the overall resistance of the formation to being drilled, it being clear from FIG. 7B that the formation intervals drilled by Bits 1, 2 and 3 is similarly difficult to drill, whereas the formation interval drilled by Bit 4 is overall less drillable than the formation intervals drilled by Bits 1, 2 and 3.

The above description has focused primarily on the example of assessing the performance of a drill bit configuration in terms of length drilled against durability or wear resistance, as may typically be of interest in assessing the performance of specialised drill bits such as PDC cutters. However, there are a great many other parameters that may be of interest in assessing the performance of these and various other drill bit configurations. Some of the other parameters which may be of interest as drillability parameters include drilling fluid flow rate; hole inclination; and dogleg severity, while parameters which may be of interest as drill bit performance parameters include the number of stringers drilled; the accumulated rock strength of stringers drilled; the time taken to drill stringers or hard rock types; the surface drilling torque; the bit drilling torque; the surface sliding torque; the bit sliding torque; mechanical specific energy; dogleg severity; accumulated bit revolutions; mean time between failures; stick slips; and vibrations. It will be noted that certain parameters can represent either a drillability parameter or a performance parameter, depending on which aspect of a drill bit configuration's performance is being assessed, but a parameter should typically not be used as both a drillability parameter and a drill bit performance parameter in the same analysis.

As drillability parameters, the drilling fluid flow rate; hole inclination; and dogleg severity can give useful insight into the respective difficulty for a drill bit configuration to drill its respective interval.

The drilling fluid flow rate is controlled by the rig. This influences the drillability of the formation via the associated effect on the HHSI (Hydraulic Horsepower per Square Inch) coming out of the bit nozzles, and the resultant IF (Impact Force) of the fluid on the rock at the bottom of the well bore. These two parameters (HIS, IF) are important to help fail the rock and increase ROP, and can also affect PDC cutter cooling (which will affect the bit life) and the ability to clean cuttings out of the way and get proper ROP (if cuttings are not cleared out of the way, the drill bit is forced to drill through the cuttings again to get to the fresh rock beneath).

In general, a high drilling fluid flow rate is desirable for helping to fail the rock, clear away cuttings and cool the drill bit. However, there has to be an equilibrium to avoid lifting the bit off the bottom if too much force is generated by the fluid being ejected from the nozzles. Maintaining a higher drilling fluid flow rate also generally requires more power. It may therefore be desirable to utilise drill bit configurations which will achieve similar drilling performance, but at lower HHSI.

Turning to hole inclination, there are several factors that can influence ROP and bit wear. One is the efficiency of weight transfer to the bit—a higher proportion of the weight is transferred to the bit, in the direction of drilling, when the hole being drilled is vertical. Another factor is the relative dip angle between the bit and the formation beds—if the bit attacks a new bed at angle compared to the bed, it will change the drilling dynamics and most likely slow down the ROP.

Dogleg severity represents the change in curvature in the direction of the well (both inclination and azimuth combined), and is measured in degrees per 30 m (or per 100 ft). The higher the dogleg severity, the more the applied forces (weight on bit, torque, etc.) are "lost" laterally in side forces, thereby reducing the rate of penetration.

As drill bit performance parameters, the number of stringers drilled; the accumulated rock strength of stringers drilled; the time taken to drill stringers or hard rock types; the surface drilling torque; the bit drilling torque; the surface sliding torque; the bit sliding torque; mechanical specific energy; dogleg severity; accumulated bit revolutions; mean time between failures; stick slips; and vibrations can all give an indication of the relative performance obtained by a drill bit configuration in terms of a particular criterion.

One simple measure of drill bit configuration performance is simply to count the number of stringers drilled by a drill bit. This is a quick and easy way of looking at bit performance, and does not necessarily require calculation of the rock strength, as the ROP curve can be just enough to make a quick evaluation of where stringers were encountered within the drilled interval. Using similar techniques, a more accurate appreciation for the number and extent of the stringers drilled by a particular drill bit can be obtained by isolating and accounting for different types of stringers according to their rock type and their level of rock strength. For example, one option would be to differentiate stringers above and below 20 kpsi, and to distinguish between limestone and non-limestone stringers.

The accumulated rock strength of the stingers drilled and the time taken to drill the stringers can be derived directly from the above identification of the stringers.

The accumulated rock strength of the stringers is the same as the total accumulative rock strength, but only taking into account the values for data points within the portions of the interval identified as being within a stringer. Once the stringers have been identified and their rock strength calculated, the sum of all the rock strength values associated to this group is calculated (assuming an equal spacing between data points, or otherwise adjusted for the variable spacing between data points).

One useful diagrammatic representation is to plot the accumulative rock strength against the accumulative length of stringers drilled. Alternatively, the total accumulated rock strength can be used as a data point for assessing the average ROP associated with drilling the stringers, for example. This enables the analyst to plot different bit results to compare performance.

Assessing the time taken to drill the stringers is similar in concept to assessing the ROP, and is simply calculated by adding the time increments to drill through each incremental length associated to a data point. The time to drill the incremental length at each data point is not typically recorded, but can be back-calculated as the length drilled divided by ROP. The total time can thus be determined by adding up the calculated time values, either for each stringer or for all stringers together. A further use could be to calculate an average time to drill each incremental length of the stringers (total time÷total length of stringers). It can be important for some drilling operators to know the time it takes per depth interval, or the total time, when drilling intervals including stringers, in order to make predictions for the planning of future wells.

Surface drilling torque is the torque measured at the surface, with the torque sensor placed by the rig floor, while drilling Surface sliding torque is the torque measured at the surface, with the torque sensor placed by the rig floor, while sliding (downhole motor applications).

Bit drilling torque is the torque measured by an electronic tool placed in the bottom hole assembly (BHA) nearby the bit, while drilling.

Bit sliding torque is the torque measured by an electronic tool placed in the bottom hole assembly (BHA) nearby the bit, while sliding (downhole motor applications).

The torque is really a response of the bit, BHA and/or the entire drill string to the drilling of the hole. It can be used in the same way as the ROP in the analysis of drill bit configuration performance, in order to compare the efficiency of different PDC bit designs. In the same fashion as before, the rock strength and lithology are determined to make sure that a meaningful comparison is being made, or that the analyst is aware of the differences in the rock types/hardness when comparing torque performance. The torque can be a limiting factor to drilling. Specifically, too much torque can lead to damage of the drill string, BHA or motor, which can be very costly, and can cause the bit to stall.

Weight on bit (WOB) can be a useful measure for assessing relative performance in hard rock drilling applications. Specifically, a more efficient drill bit will require less WOB to drill than a less efficient bit. WOB can be evaluated against the calculated rock strength and lithology groups (rock types) in the same manner described above.

The mechanical specific energy (MSE), also called, simply, "specific energy" is a calculated parameter combining several other drilling parameters (for example, Chevron's MSE uses WOB, ROP, bit or surface Torque and bit RPM to calculate the MSE; see, for example, SPE/IADC 92194). Essentially, the MSE represents the drilling efficiency of the bit or the BHA in terms of the energy used to drill the formation. It can be plotted or evaluated against rock strength in the same way as for ROP, torque, length drilled, etc.

One way, in particular, is to isolate the problematic formations in one group, and in that group, for each data point, calculate the difference (MSE—Rock strength (URS or CRS)), then calculate an average of these delta values over the interval of interest, and use this to compare the performance of different bit designs. This will give an average performance for each bit, where a lower value indicates a higher average efficiency. It can also be useful to plot the accumulated MSE against the length drilled in the problematic rock type(s), which will give an indication of the non-efficiency rate, and may also highlight trends such as wear acceleration of PDC cutters (as would be indicated by a rapid increase in the delta value).

The dogleg severity, and in particular variations between the planned and actual dogleg severity values, are important to evaluate the steering ability of the drill bit (typically the drill bit is determinative of the steering ability of the drill bit configuration as a whole). Of course, variations between the planned and actual dogleg severity values are not always due to the bit having poor steering ability, and it could be that the directional driller is inexperienced and needs to make a lot of corrections to the well path due to his/her lack of precision in the commands, or that the BHA is not optimised for the directional plan. Such background knowledge is useful when assessing the performance (steering ability) of a particular drill bit or drill bit configuration. However, in the normal case, where drilling operator experience and BHA design are not questionable, then the bit is more likely the major driver for variations in the dogleg severity.

Knowledge of the rock strength and lithology identification are also important here, as background information, since dogleg variations may be also influenced or amplified by changes in formation strength/type by applying unwanted side forces to the bit and BHA components.

With appropriate background knowledge, groups of data points can be isolated to make sure that similar lithology and rock strengths are being compared, or otherwise the analyst must make sure to be aware of the differences and possible effects of these factors on the dogleg performance (steering ability). In a related assessment, the dogleg severity can be plotted against length drilled, or it is possible to calculate the accumulative deviation of the actual dogleg severity away from the planned or mean dogleg severity over a defined interval, and to calculate the average of this deviation over this same interval, where the more deviation means the worse performance in terms of steering ability. In this regard, it is also important to understand the type of drill bit configuration being assessed, as certain drill bits can have very high dog leg curvature capability, but not be very smooth to steer in low curvatures applications. In this connection, it is also possible to calculate the accumulative deviation of dogleg from the planned dogleg severity over a defined interval, and to calculate the average of this deviation over this same interval, where the more deviation means the worse performance in steering ability.

Another parameter of interest is the accumulated bit revolutions (sum of RPM×drill time×60), or kRevs. This is an indicator of bit life when compared against dull grading, rock strength and lithology, and also WOB.

Related more to components of the drill bit configuration, rather that the drill bit itself, is the assessment of downhole tool failures (DTF), in particular of measuring while drilling (MWD) and directional drilling (DD) electronic tools. This can indicate the reliability of one type or make of one downhole tool as compared to another available type or make.

In the case where DTF can be attributed reliably to the vibrations caused by drilling the hole, the calculation of Mean Time Between Failures (MTBF) of the tools used on the wells to be compared can also be a performance indicator of bit stability and the ability of the bit not to create damaging vibrations (i.e., its ability to drill smoothly). In general, the smoother the drilling, the fewer vibrations are generated, and the longer the electronic tool's life will be. In this case, the rock strength and lithology can be used as background information, since differences in these parameters influence the vibrations generated by the bit (i.e., the more hard rock or stringers the drill bit encounters, the more likely it is to generate vibrations). In a similar manner to the calculation of effective length drilled above, an effective or equivalent MTBF can be precisely calculated by isolating the problematic formation types and assessing the relevant rock strength, and thereafter calculating the equivalent MTBF in equivalent problematic lengths drilled.

If it is desired to make a comparison directly between two specific downhole tools, irrespective of the drill bit configuration in which they are each employed, then one can eliminate the effect of different drill bit configurations on the performance of the downhole tool by calculating the equivalent MTBF in equivalent problematic rock intervals between two tool failures by using the same bit design in both cases.

Stick slips (where the bit digs into the formation and stops, and then suddenly releases (usually at high speed), which can lead to "twist offs" and impact damage on cutters) and other types of vibrations that are measured downhole by the MWD and DD tools (axial and/or lateral and/or torsional vibrations) are also indicative of bit performance (i.e., the ability of a bit not to generate vibrations), when these vibrations are knowingly attributable to the bit's interaction with the formation. Typically, such vibrations are interpreted as being of low risk, medium risk and high risk levels. The vibration values (the unit or quantity depends solely on the type, size and brand of the measurement tool) can be evaluated by calculating an average of the vibration values over the interval of interest (if appropriate, taking account only of values isolated by the lithology and rock strength identified) or by plotting an accumulated value of vibration level against the equivalent length drilled in the interval of interest. In the latter case, the steeper the slope, the less smooth the bit is and the more it is likely to cause damaging vibrations.

The level of vibrations (low, medium, high) can also usefully be plotted as a histogram, for example with one histogram per level. For example, if the high risk level is isolated, i.e., if we consider only the data points where high risk level vibrations occur, it is possible to plot the distribution (histogram) of these vibration occurrences against the rock strength. If comparing two bits in this way, the one which has a greater level of occurrences of high risk vibrations at lower intervals of rock strength values is more likely to generate harmful vibrations, and so is more likely to cause expensive failures to the drilling equipment, as may lead to incapacity of BHA components or downhole tools or to "twist offs", where the drill bit becomes unscrewed from the drill string, etc., which result in the drill string having to be pulled out.

The invention claimed is:

1. A method for assessing drilling performance of a drill bit configuration used to drill at least a portion of a wellbore in a formation, comprising:

determining a value of at least one drill bit performance parameter at multiple points along an interval of the portion of the wellbore drilled using the drill bit configuration;

determining drilling performance for the drill bit configuration in the interval based on the value of the drill bit performance parameter;

determining at least one rock characteristic for the interval;

assessing effectiveness of the drill bit configuration for drilling the interval based on the determined drilling performance and the determined rock characteristic; and configuring a drill bit based on the drill bit configuration.

2. The method of claim 1, wherein the method further comprises determining a value of at least one drillability parameter for the formation at each of the multiple points along the interval, and wherein determining the drilling performance for the drill bit configuration in the interval or determining the at least one rock characteristic is based on the determined values of the at least one drillability parameter at the multiple points.

3. The method of claim 2, further comprising dividing the multiple points into groups based on the determined values of the at least one drillability parameter at each of the multiple points.

4. The method of claim 3, further comprising:

determining a length value at each of the multiple points, corresponding to a length drilled by the drill bit configuration; and determining a percentage of the interval constituted by the multiple points in at least one of the groups, the percentage corresponding to the sum of the length values of the multiple points within the at least one group out of the total length of the interval.

5. The method of claim 4, wherein the length value at each point is determined by calculating at least one from the group consisting of:

the distance between that point and the adjacent next point;

half of the distance between the adjacent previous point and the adjacent next point; and the length of the whole interval divided by the total number of the multiple points.

6. The method of claim 3, further comprising determining a percentage of the interval, the percentage corresponding to the total number of points within the at least one group out of the total number of the multiple points along the interval.

7. The method of claim 2 wherein the at least one drillability parameter is selected from the group consisting of:

unconfined rock strength;

confined rock strength;

weight on bit; and bit rotation speed;

drilling fluid flow rate;

hole inclination;

dogleg severity; and any combinations thereof.

8. The method of claim 1, wherein determining at least one rock characteristic comprises determining a value of at least one lithology parameter for the formation at each of the multiple points along the interval.

9. The method of claim 1, wherein determining the at least one rock characteristic for the interval includes determining the percentage of two or more different rock types within the formation in the interval.

10. The method of claim 1, wherein determining the at least one rock characteristic for the interval includes determining the rock type at each of the multiple points along the interval.

11. The method of claim 1, wherein determining the drilling performance for the drill bit configuration includes determining an average value for the drill bit performance parameter by performing at least one calculation selected from the group consisting of:

dividing the sum of the values for the drill bit performance parameter for the multiple points along the interval by the total number of the multiple points; and multiplying the value of the drill bit performance parameter for each point along the interval by the length value for that point to obtain a length-weighted performance value for each point, and dividing the sum of the length-weighted performance values for the multiple points by the total length of the interval.

12. The method of claim 11, wherein determining an average value for the drill bit performance parameter includes determining a group average performance parameter value, comprising:

determining the average performance parameter value for a first set of one or more of the groups; and determining the average performance parameter value for a second set of one or more of the groups, different from the groups in the first set.

13. The method of claim 12, wherein determining a group average performance parameter value includes one selected from the group consisting of:

determining the average performance parameter value for a number of sets, each set including one or more groups different from the groups in any of the other sets, wherein every group is included in one of the sets; and determining the average performance parameter value for each group.

14. The method of claim 12, wherein determining the drilling performance for the drill bit configuration in the interval includes multiplying the determined average performance parameter for each group by a drillability weighting factor and summing all of the drillability-weighted average performance parameters for each determined group.

15. The method of claim 11 wherein determining an average value for the drill bit performance parameter includes—determining a rock type average performance parameter value, by performing at least one calculation selected from the group consisting of:

dividing the sum of the values for the drill bit performance parameter for points corresponding to at least one of two or more rock types within the formation by the total number of points corresponding to the at least one rock type; and multiplying the value of the drill bit performance parameter for each point corresponding to at least one of two or more rock types by a length value for that point to obtain a length-weighted performance value for each point corresponding to the at least one rock type, calculating a total length value for the at least one rock type as the sum of the length values for the points corresponding to the at least one rock type, and dividing the sum of the length-weighted performance values by the total length value for the at least one rock type.

16. The method of claim 15, wherein determining a rock type average performance parameter includes at least one calculation selected from the group consisting of:

determining the average performance parameter value for a number of sets, each set including one or more of the rock types different from the rock types in any of the other sets; and determining the average performance parameter value for two or more, or each, of the rock types.

17. The method of claim 15, wherein determining the drilling performance for the drill bit configuration in the interval includes multiplying the determined average performance parameter for each rock type by a drillability weighting factor to obtain a drillability-weighted average performance parameter and summing all of the drillability-weighted average performance parameters for each determined rock type.

18. The method of claim 1, wherein assessing the effectiveness of the drill bit configuration for drilling the interval based on the determined drilling performance and the determined rock characteristic comprises eliminating a selection of points, out of the multiple points along the interval, from the determination of the drilling performance—for the drill bit configuration in the interval.

19. The method of claim 1, wherein assessing the effectiveness of the drill bit configuration for drilling the interval based on the determined drilling performance and the determined rock characteristic comprises applying a weighting factor to one or more drilling performance values.

20. The method of claim 1, wherein assessing the effectiveness of the drill bit configuration for drilling the interval based on the determined drilling performance and the determined rock characteristic comprises plotting at least one drillability parameter as an accumulative drillability parameter against length drilled.

21. The method of claim 1, wherein the at least one drill bit performance parameter is selected from the group consisting of:

length drilled;
rate of penetration;
bit wear volume;
bit dull grade;
number of stringers drilled;
accumulated rock strength of stringers drilled;
time taken to drill stringers or hard rock types;
surface drilling torque;
bit drilling torque;
surface sliding torque;
bit sliding torque;
weight on bit;
mechanical specific energy;
dogleg severity;
accumulated bit revolutions;
mean time between failures;
stick slips;
vibrations; and
any combinations thereof.

22. A method for comparing the drilling performance of at least two different drill bit configurations each used to drill at least a portion of a wellbore in a formation, comprising:

assessing the drilling performance of each drill bit configuration during the drilling of respective intervals in respective portions of the same or different wellbores by:

determining a value of at least one drill bit performance parameter along at least multiple points along an interval of the portion of wellbore drilled using the drill bit configuration;

determining drilling performance for the drill bit configuration in the interval based on the value for the drill bit performance parameter at multiple points;

determining at least one rock characteristic for the interval;

assessing the effectiveness of the drill bit configuration for drilling the interval based on the drilling performance and the at least one rock characteristic;

comparing the respective assessed drilling performances; and configuring a drill bit based on the drill bit configuration.

23. The method of claim 22, wherein comparing the respective assessed performances comprises determining an effective drilling performance for each drill bit configuration by normalizing the drilling performances of all compared drill bit configurations based on the respective rock characteristics determined for the interval drilled by each drill bit configuration.

24. The method of claim 23, wherein normalizing is based on at least one parameter selected from the group consisting of:

the effective length drilled in a particular type of rock;

the effective average rate of penetration in a particular type of rock;

the effective rate of wear in a particular type of rock;

the effective length drilled in formation rocks having a particular range of values of at least one drillability parameter;

the effective average rate of penetration in formation rocks having a particular range of values of at least one drillability parameter;

the effective rate of wear in formation rocks having a particular range of values of at least one drillability parameter; and any combinations thereof.

25. The method of claim 23, wherein determining an effective drilling performance for each drill bit configuration includes adjusting the respective assessed drilling performances by eliminating data in non-comparable sections of the respective drilled intervals.

26. The method of claim 22, wherein comparing the respective assessed performances comprises plotting at least one drillability parameter as an accumulative drillability parameter against length drilled for each drill bit configuration.

* * * * *